US008263300B2

(12) United States Patent
Toshine

(10) Patent No.: US 8,263,300 B2
(45) Date of Patent: Sep. 11, 2012

(54) ELECTROPHOTOGRAPHIC PHOTOCONDUCTOR, IMAGE FORMING APPARATUS, AND PROCESS CARTRIDGE

(75) Inventor: Tetsuya Toshine, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 509 days.

(21) Appl. No.: 12/395,135

(22) Filed: Feb. 27, 2009

(65) Prior Publication Data

US 2009/0220875 A1 Sep. 3, 2009

(30) Foreign Application Priority Data

Mar. 3, 2008 (JP) ..... 2008-052506
May 20, 2008 (JP) ..... 2008-132528

(51) Int. Cl.
*G03G 15/04* (2006.01)

(52) U.S. Cl. ..... 430/60; 430/56; 430/58.7; 430/59.4; 430/66

(58) Field of Classification Search ..... 430/58.05, 430/58.7, 58.75, 59.1, 59.4, 60, 66, 69, 59.6
See application file for complete search history.

(56) References Cited

U.S. PATENT DOCUMENTS 7,029,811 B2 * 4/2006 Azuma et al. ..... 430/69
2004/0265716 A1 * 12/2004 Itami et al. ..... 430/58.8
2006/0051689 A1 * 3/2006 Suzuki et al. ..... 430/66
2007/0059039 A1 * 3/2007 Shimoyama et al. ..... 399/159
2008/0057427 A1 * 3/2008 Sakimura et al. ..... 430/58.8

FOREIGN PATENT DOCUMENTS

| | | |
|---|---|---|
| JP | 3-45962 | 2/1991 |
| JP | 5-181299 | 7/1993 |
| JP | 7-281463 | 10/1995 |
| JP | 9-26685 | 1/1997 |
| JP | 2000-284514 | 10/2000 |
| JP | 2001-194813 | 7/2001 |
| JP | 2002-6526 | 1/2002 |
| JP | 2002-82465 | 3/2002 |
| JP | 2002-229241 | 8/2002 |
| JP | 2003-35965 | 2/2003 |
| JP | 2004-198819 | 7/2004 |
| JP | 3754942 | 12/2005 |
| JP | 2006-11485 | 1/2006 |
| JP | 2006-99028 | 4/2006 |
| JP | 2006-154753 | 6/2006 |
| JP | 2006-235513 | 9/2006 |
| JP | 2006-243746 | 9/2006 |
| JP | 2006-259141 | 9/2006 |
| JP | 2007-86176 | 4/2007 |
| JP | 2008-152241 | 7/2008 |

* cited by examiner

*Primary Examiner* — Mark F Huff
*Assistant Examiner* — Stewart Fraser
(74) *Attorney, Agent, or Firm* — Cooper & Dunham LLP

(57) ABSTRACT

The present invention provides an electrophotographic photoconductor having a support, at least an intermediate layer, and a photosensitive layer, the intermediate layer and photosensitive layer being laid in this order over the support, wherein the intermediate layer comprises an amorphous oxide semiconductor.

17 Claims, 7 Drawing Sheets

ELECTROPHOTOGRAPHIC PHOTOCONDUCTOR, IMAGE FORMING APPARATUS, AND PROCESS CARTRIDGE

BACKGROUND

1. Technical Field

This disclosure relates to an electrophotographic photoconductor capable of preventing a reduction in chargeability and occurrence of background smear and charging failure without causing an increase in potential at the exposed area even when continuously used over a long period of time, to an electrophotographic image forming apparatus such as a copier, printer, facsimile or a composite apparatus including a combination of functions processed by the above apparatuses each using the electrophotographic photoconductor, to an image forming method using the electrophotographic photoconductor, as well as to a process cartridge using the electrophotographic photoconductor.

2. Description of the Related Art

In recent years, from the viewpoints of saving office space and further widening business opportunities, and the like, electrophotographic image forming apparatus are desired to achieve high-speed performance, down-sizing, colorization, high-image quality performance as well as easy maintenance performance.

The achievement of these requirements is linked to improvements in physical properties and durability of electrophotographic photoconductors, and thus it is positioned as "the problem to solve" through developments of electrophotographic photoconductors. As one of the developments, from the perspective of improvements in easy maintenance performance of electrophotographic image forming apparatus, a reduction in replacement frequency of electrophotographic photoconductor is exemplified. The reduction in replacement frequency of electrophotographic photoconductor is closely relates to reducing major image defects caused by electrophotographic photoconductor as much as possible for a long period of time, and thus it means that providing long-life to electrophotographic photoconductor is required. This also relates to high-image quality performance of outputted images over a long period of time. Therefore, in recent years, lots of developments pertinent to providing longer life to electrophotographic photoconductors have been reported.

To achieve longer life of electrophotographic photoconductors, important is attached to improvement in durability to various hazards that could be incurred by electrophotographic photoconductors in image formation process. The hazards mentioned above are broadly classified into two types, i.e., mechanical hazards and electric hazards.

By way of example of mechanical hazards, there are hazards attributable to blade cleaner or blade cleaning device which is one of units for removing residual toner remaining on an electrophotographic photoconductor (in so-called toner cleaning process) after image transfer in image formation process. The blade cleaning device is a unit to forcedly remove residual toner from the surface of an electrophotographic photoconductor by making an elastic member (a so-called cleaning blade) in contact with the electrophotographic photoconductor, and exhibits remarkable toner removing ability in a narrow space, and thus the use of blade cleaning device is highly advantageous in downsizing of electrophotographic apparatus. On the other hand, such disadvantages of blade cleaning devices are pointed out that an electrophotographic photoconductor surface is abraded with an elastic member in a state of being in direct contact with the elastic member, and therefore a large mechanical stress is imposed on an electrophotographic photoconductor, and a layer functioning as an outermost surface layer of the photoconductor tends to wear. For this reason, in electrophotographic apparatus employing this cleaning process mode, abrasion of electrophotographic photoconductor surfaces often poses an impediment to providing longer life to the electrophotographic apparatus. To solve the problem, a technique is proposed in which high-hardness protective layers are vertically stacked (see Japanese Patent Application Laid-Open (JP-A) Nos. 5-181299, 2002-6526, 2002-82465, 2000-284514 and 2001-194813).

The following explains electrostatic hazards. In a typical image formation process, a charge is imparted to an electrophotographic photoconductor surface until the photoconductor is charged to a predetermined electric potential, and then the charge remaining on the electrophotographic photoconductor surface is removed by exposing the electrophotographic photoconductor to light. On this occasion, the charge passes through individual layers (e.g. a surface layer, charge generating layer, charge transporting layer, and intermediate layer) of the electrophotographic photoconductor, thereby an electrostatic stress is impressed on the electrophotographic photoconductor. Electrophotographic photoconductors which are widely diffused at the present time are mostly occupied by electrophotographic photoconductors consisting of organic materials. In the electrophotographic process where charging and removal of charge are repeatedly carried out, an organic material constituting an electrophotographic photoconductor gradually deteriorates by an electrostatic hazard to cause reductions in electrophotographic properties as typified by occurrence of charge trapping in layers of the electrophotographic photoconductor, a change in chargeability. It has been known that in particular a reduction in chargeability largely affects the quality of outputted image to cause a serious problem such as a reduction in image density, occurrence of background smear, and nonuniformity of image when continuously outputted.

There are various factors which are found to cause a reduction in chargeability of a photoconductor. For example, it is pointed out that electrostatic discharge product generated in charging process step in an image formation process has an influence on electrostatic properties of the photoconductor used (see Japanese Patent Application Laid-Open (JP-A) Nos. 9-26685, 2002-229241, and 2006-99028), whereby the bulk conductivity of bulk of a charge transporting layer and a surface layer of the photoconductor, leading to a reduction in chargeability of the photoconductor. To solve the problem, a technique is disclosed which prevents reduction in chargeability by adding an antioxidant to a charge transporting layer and a surface layer of an electrophotographic photoconductor (see Japanese Patent Application Laid-Open (JP-A) No. 2006-99028). Also, a charging technique is disclosed as a charging process, which causes less electrostatic discharge product (see Japanese Patent Application Laid-Open (JP-A) Nos. 9-26685 and 2002-229241). The use of the charging method in image formation process makes it possible to prevent reduction in chargeability of electrophotographic photoconductor caused by electrostatic discharge product.

As another factor of the reduction in chargeability, deterioration of an intermediate layer can be considered. Intermediate layers which are presently widely used are each formed in a dispersoid where inorganic fine particles are dispersed in a binder consisting of an organic resin and is said to preferably have a function of preventing electric charges from being injected from a support into a photosensitive layer and another function of transporting electric charges generated in the photosensitive layer to the support. For example, when the function of preventing electric charges from being injected from a support into a photosensitive layer does not satisfactorily work in an electrophotographic photoconductor, electric charges having a polarity opposite to the polarity of the electrophotographic photoconductor are injected from the support into the photosensitive layer on the occasion of charging the electrophotographic photoconductor, electric charges residing on the photoconductor surface are easily removed, causing a phenomenon that a desired charge amount is hardly obtained. When the function of transporting electric charges generated from the photosensitive layer to the support does not satisfactorily work, an increase in potential resulting from a reduction in charge generation easily occurs at an exposed area, and deficiency of chargeability easily takes place due to charge trapping in an intermediate layer. Various techniques to satisfy and maintain both of the two functions have been developed, however, these functions are generally in a conflicting relation each other, and it is very difficult to simultaneously satisfy and maintain both of the two functions. For instance, a technique is disclosed which improves a preventive effect against the injection of electric charges by employing a high-insulation layer as a structural layer of an intermediate layer (see Japanese Patent Application Laid-Open (JP-A) Nos. 3-45962 and 7-281463). It is reported that when this technique is used in an electrophotographic photoconductor, image defects, such as background smear, appeared due to a reduction in chargeability of the photoconductor are significantly reduced and outputted images can be kept high in quality even after repetitive use of the photoconductor. On the other hand, the function of transporting electric charges from a charge generating material to a support, which is another function played by an intermediate layer, becomes insufficient to easily cause an increase in potential at an exposed area, a charging defect and the like, and through repetitive use of an electrophotographic photoconductor, a phenomenon like an increase in potential at an exposed area and a charging defect becomes easily obvious.

Further, for example, a technique is proposed in which an electron transporting material is blended in an intermediate layer of an electrophotographic photoconductor whose surface is to be negatively charged in an image forming process (see Japanese Patent Application Laid-Open (JP-A) No. 2006-259141). According to the proposed technique, electric charges having a polarity opposite to the polarity of electric charges residing on the surface of a photoconductor (in this case, positive charge) is less injected into the photosensitive layer and a negative charge generated in the charge generating layer can be transported to the support, making it possible to obtain an intermediate layer which simultaneously satisfy both of the two functions described above. An electrophotographic photoconductor employing such an intermediate layer can exhibit highly superior electrophotographic properties in the initial stage of use of the photoconductor. This proposed technique, however, inconveniently causes degradation of electrophotographic properties by a repetitive electrostatic hazard. More specifically, an organic material constituting an intermediate layer tends to easily deteriorate due to a small amount of an electron transporting material exhibiting superior electron transfer property, contained in the intermediate layer and due to a repetitive electrostatic hazard, and further electron transporting material tends to easily form trapped charge under the influence of oxygen in the air.

Accordingly, an electrostatic photoconductor that can prevent electric charges from being injected from a support into a photosensitive layer without causing an increase in potential at an exposed area, and without substantially causing degradation of electrophotographic properties such as a degradation of chargeability even after use for a long period of time and enables to continuously obtain a high-quality image with less image defects; and an image forming method, and image forming apparatus and a process cartridge each using the electrophotographic photoconductor have not yet been obtained, and it is desired to quickly provide the photoconductor, image forming method, image forming apparatus and process cartridge.

BRIEF SUMMARY

In an aspect of this disclosure, there is provided an electrophotographic photoconductor that has an intermediate layer composed of an amorphous oxide semiconductor and that can prevent electric charges from being injected from a support into a photosensitive layer without causing an increase in potential at an exposed area, and without substantially causing degradation of electrophotographic properties such as a degradation of chargeability even after use for a long period of time and enables to continuously obtain a high-quality image with less image defects; and an image forming method, and image forming apparatus and a process cartridge each using the electrophotographic photoconductor.

It was found through extensive studies and examinations that by providing at least an intermediate layer and a photosensitive layer in this order over a support and using an amorphous oxide semiconductor for the intermediate layer, it is possible to produce an electrophotographic photoconductor that can prevent unnecessary electric charges from being injected from the support into the photosensitive layer and that can greatly reduce defects of outputted image without substantially causing charge trapping in the intermediate layer, without substantially causing injection of unnecessary electric charge from the support even under long time use and without substantially causing a reduction in its chargeability for a long period of time. Also, it was found that by using as the amorphous oxide semiconductor an amorphous oxide containing at least indium, zinc and gallium, the above effects can be remarkably exhibited.

Use of the aforementioned electrophotographic photoconductor makes it possible to prevent unnecessary electric charges from being injected into a charge generating layer and a charge transporting layer from the intermediate layer as well as to efficiently transport an electric charge generated from a charge generating material to the support. Since an intermediate layer formed by a technique is highly resistant to charging hazards, it can maintain the above properties for a long period of time. As a result, it is possible to provide a long-lived electrophotographic photoconductor which less causes defects of outputted image such as a reduction in image density and occurrence of background smear and which has durability to mechanical hazards derived from image formation process Many other aspects and features can be provided, such as, for example (but not limited to), the following:

<1> An electrophotographic photoconductor having:

a support, at least an intermediate layer, and a photosensitive layer, the intermediate layer and photosensitive layer being laid in this order over the support, wherein the intermediate layer contains an amorphous oxide semiconductor.

<2> The electrophotographic photoconductor according to <1>, wherein the amorphous oxide semiconductor contains at least indium, zinc, and gallium.

<3> The electrophotographic photoconductor according to <1>, wherein the photosensitive layer is a multilayered type which is formed of a charge generating layer and a charge transporting layer.

<4> The electrophotographic photoconductor according to <1>, wherein the photosensitive layer contains phthalocyanine as a charge generating material.

<5> The electrophotographic photoconductor according to <4>, wherein the phthalocyanine has a maximum diffraction peak at a Bragg angle of (2θ±0.2°) 27.2° and a minimum diffraction peak at 7.3° in an X-ray diffraction spectrum with a CuKα radiation source.

<6> The electrophotographic photoconductor according to <1>, wherein the photosensitive layer contains a binder resin, and the binder resin is a polymeric charge transporting material.

<7> The electrophotographic photoconductor according to <6>, wherein the polymeric charge transporting material is at least one polymer selected from polycarbonates, polyurethanes, polyesters, and polyethers.

<8> The electrophotographic photoconductor according to <7>, wherein the polymeric charge transporting material has a triarylamine structure.

<9> The electrophotographic photoconductor according to <1>, further having a surface layer on the photosensitive layer, wherein the surface layer contains a hardened material composed of at least a radically polymerizable compound, and a photoradical polymerization initiator.

<10> The electrophotographic photoconductor according <9>, wherein a functional group of the radically polymerizable compound is at least one selected from acryloyloxy groups, and methacryloyloxy groups.

<11> The electrophotographic photoconductor according to <10>, wherein the radically polymerizable compound is a radically polymerizable compound having no charge transporting structure.

<12> The electrophotographic photoconductor according to <10>, wherein the radically polymerizable compound is a mixture of a radically polymerizable compound having no charge transporting structure, and a radically polymerizable compound having a charge transporting structure.

<13> The electrophotographic photoconductor according to <12>, wherein a charge transporting portion of the radically polymerizable compound having a charge transporting structure has a triarylamine structure.

<14> The electrophotographic photoconductor according to <1>, wherein the support has a surface roughness (Rz) of 0.6 μm or more.

<15> An image forming apparatus including:

an electrophotographic photoconductor, a charging unit configured to charge a surface of the electrophotographic photoconductor, an exposing unit configured to expose the surface of the electrophotographic photoconductor to form a latent electrostatic image, a developing unit configured to develop the latent electrostatic image using a toner to form a visible image, and a transfer unit configured to transfer the visible image onto a recording medium, wherein the electrophotographic photoconductor has a support, at least an intermediate layer, and a photosensitive layer, the intermediate layer and photosensitive layer being laid in this order over the support, wherein the intermediate layer contains an amorphous oxide semiconductor.

<16> A process cartridge detachably mounted on a main body of an image forming apparatus, the process cartridge including:

at least an electrophotographic photoconductor, and a developing unit configured to develop a latent electrostatic image formed on the electrophotographic photoconductor using a toner to form a visible image, wherein the electrophotographic photoconductor has a support, at least an intermediate layer, and a photosensitive layer, the intermediate layer and photosensitive layer being laid in this order over the support, wherein the intermediate layer contains an amorphous oxide semiconductor.

Figure 1:
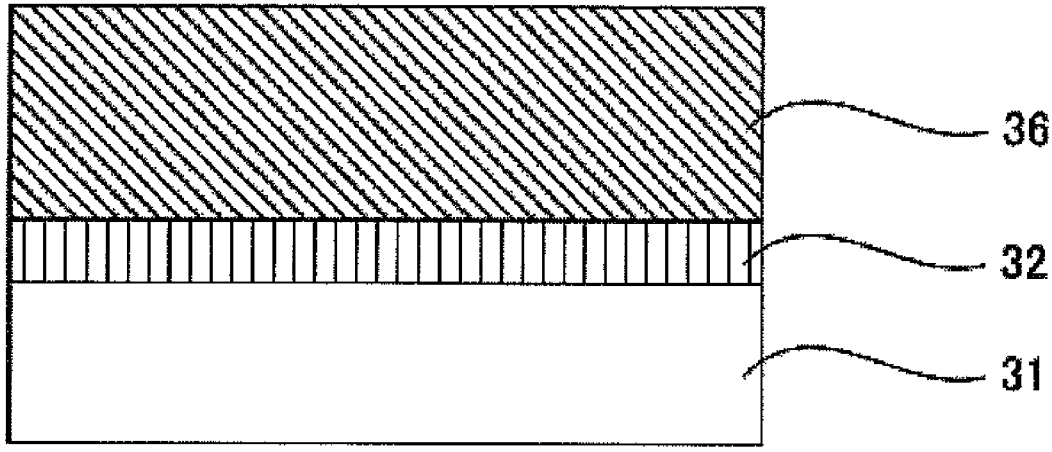
FIG. 1 is a schematic cross-sectional view showing one example of a layer structure of an electrophotographic photoconductor of the present invention.

DETAILED DESCRIPTION OF THE INVENTION (Electrographic Photoconductor)

An electrophotographic photoconductor of the present invention has a support, at least an intermediate layer and a photosensitive layer disposed in this order on the support and further has other layers.

<Intermediate Layer>

The intermediate layer is preferably provided with both a function of preventing unnecessary electric charges (electric charges having a polarity opposite to the polarity of the photoconductor) from being injected from the support to the photosensitive layer and a function of transporting, among electric charges generated in the photosensitive layer, electric charges having same polarity to that of the photoconductor. For example, when as an image formation process, it is necessary to negatively charge a photoconductor surface, the intermediate layer should be provided with a function of preventing positive holes from being injected from the support into the photosensitive layer (hole blocking property) and a function of transporting electrons from the photosensitive layer to the support (electron transportability). Also, to obtain a long-lived electrophotographic photoconductor, it is important that the hole blocking property and electron transportability are not changed by a repetitive electrostatic hazard.

As the properties that the intermediate layer must have in order to have the hole blocking property, the following are exemplified: the ionization potential of the intermediate layer or the work function in a band filled with electrons in the intermediate layer must be greater than the Fermi level of the support; and the positive hole transportability of the intermediate layer itself must be extremely small. As a material having these properties, n-type semiconductive materials are preferably exemplified. In terms of work function, materials having a relatively large band gap are also preferably exemplified. Further, as the properties that the intermediate layer must have in order to transport electrons generated in the photosensitive layer to the support, i.e., for the purpose of electron transportability, the following are exemplified: the electron affinity of the intermediate layer must be smaller than the electron affinity of the photosensitive layer; and the intermediate layer must have electron transportability.

As such an intermediate layer that satisfies these properties, electron transporting layers each formed by dispersing an organic material having an electron transporting structure in a binder, and inorganic semiconductor layers of n-type are exemplified. As materials difficult to vary these properties due to an electrostatic hazard, it is preferable to use the latter, i.e., n-type inorganic semiconductors. Further, in the light of in-plane variation of electric properties in devices each having a relatively large surface area as typified by electrophotographic photoconductors, the material of the intermediate layer is preferably amorphous.

The amorphous oxide means an oxide whose atomic arrangement is irregular and in a solid state. The amorphous oxides are broadly classified into glass oxide semiconductors each obtained by quenching an oxide being in a fluid state and amorphous oxide semiconductors each formed by sputtering at a relatively low temperature. In the light of heat resistance of the support, it is preferred to select the latter type of amorphous oxide semiconductors.

The amorphous oxide semiconductor usable for the intermediate layer is not particularly limited and may be suitably selected in accordance with the intended use. Examples thereof include indium oxides, indium, amorphous oxide semiconductors containing at least two elements of zinc and tin; amorphous oxide semiconductors containing at least two elements selected from indium, zinc and gallium; amorphous oxide semiconductors containing at least two elements selected from indium, tin and zinc; amorphous oxide semiconductors containing at least two elements selected from indium, tungsten and zinc; and amorphous oxide semiconductors containing at least two elements selected from yttrium, manganese and titanium (which are formable by low-temperature film formation). Among these, amorphous oxide semiconductors consisting of three elements of indium, zinc and gallium are particularly preferable from the perspective of electrostatic stability and electric conductivity.

—Film Forming Method of Amorphous Oxide Semiconductor—

The method of forming a film of the amorphous oxide semiconductor over the support is not particularly limited and may be suitably selected from among common film forming methods of inorganic materials.

The common film forming methods are broadly classified into vapor phase growth methods, liquid phase growth methods, and solid phase growth methods.

The vapor phase growth methods are further classified into physical vapor deposition (PVD) method, and chemical vapor phase deposition (CVD) method.

Examples of the physical vapor phase deposition method include vacuum evaporation, electron beam evaporation, laser abrasion method, laser abrasion MBE, MOMBE, reactive evaporation, ion-plating, cluster ion-beam method, glow discharge sputtering, ion-beam sputtering, and reactive sputtering.

Examples of the chemical vapor phase deposition method include heat CVD, MOCVD (metal organic chemical vapor deposition), RF (radio-frequency) discharge plasma CVD, ECR plasma CVD, optical CVD, and laser CVD. Examples of the liquid phase growth method include LPE method, electric plating, electroless plating, and liquid coating method. Examples of the solid phase growth method include SPE method, recrystallization method, graphoepitaxy method, LB method and sol-gel method.

Among these film formation methods, in order to form a homogeneous film over a relatively large-area region such as an electrophotographic photoconductor surface, physical vapor deposition methods are widely used. Among the physical vapor deposition methods, when it is necessary to minutely control the composition of an amorphous oxide semiconductor, laser abrasion method is preferable; and when the mass-production of a film is necessary, various sputtering methods are preferably employed.

The following explains, in detail, film formation conditions for amorphous oxide semiconductor, in particular, film formation conditions used in sputtering method.

—Washing of Substrate (Support)—

To obtain an amorphous oxide semiconductor exhibiting uniform electric property, it is significantly important to wash a substrate (a support in the present invention) on which an amorphous oxide semiconductor is to be film-formed. To obtain a support with a clean surface, it is ideal that at least contaminated matters other than the support itself (e.g. aluminum) are not present, however, it is very difficult to achieve such a state. It is therefore advisable to obtain a desired support surface by using commonly proposed washing method in accordance with the necessary amount of contaminated matters on the support surface, performance of an apparatus used in experiments and the like. The washing method is not particularly limited and may be suitably selected in accordance with the intended use. Examples thereof include wet washing method, sputter etching method, thermal etching of high-temperature, thermal etching of low-temperature, electron-beam irradiation etching, synchrotron radiation etching, and laser beam irradiation etching.

—Target—

On the occasion of forming the amorphous oxide semiconductor onto a support by sputtering, a polycrystalline sintered body containing elements constituting a generally formed amorphous oxide semiconductor is used. The elements used for the polycrystalline sintered body may be suitably selected depending on the constituent elements of an amorphous oxide semiconductor layer to be formed.

To obtain an amorphous oxide semiconductor composed of at least indium, zinc and gallium, it is necessary to use a polycrystalline sintered body containing at least indium, zinc and gallium. Such a polycrystalline sintered body can be prepared by a commonly known method of producing a target. By way of example, individual powders of indium oxide, zinc oxide and gallium oxide are mixed at a desired mixing ratio and wet-mixed with ethanol until the mixture becomes homogenous and then sintered to thereby a target can be obtained.

For the sake of controlling the conductivity of the resultant amorphous oxide semiconductor, desired impurities may be doped into the target. A metal used to dope is not particularly limited and may be suitably selected in accordance with the intended use. Examples thereof include, Li, Na, Mn, Ni, Pd, Cu, Cd, C, N, P, Ti, Zr, V, Ru, Ge, Sn, and F.

—Pressure during Film Formation—

In the sputtering method, a target is applied with an electric field in the film formation process to thereby generate plasma. Therefore, when a sputtering treatment is employed, it is necessary to form a pressure reduction atmosphere using a vacuum chamber or the like. When the pressure reduction is sufficient in film formation, plasma may not be formed, or a nonuniform film may be formed due to instability of the formed plasma, and thus a film should be formed with regard to the setting of the pressure reduction atmosphere. It is advisable to select a pressure reduction atmosphere depending on the film formation method and apparatus employed, the environmental conditions, the desired film quality, and the like.

—Type of Inflow Gas—

In the film formation by sputtering, a plasma is formed while introducing a mixed gas of an inactive gas and an oxygen gas to thereby an amorphous oxide semiconductor can be formed over a substrate (support) disposed facing a counter electrode. The inactive gas used in the sputtering treatment is not particularly limited as long as it is a commonly used inactive gas. For instance, gases typified by a gas selected from the Group 18 of periodic table of elements such as helium, argon, and gases typified by nitrogen gas are exemplified. In order to add the impurities, one or more types of gas may be used in addition to an inactive gas and oxygen gas.

—Oxygen Partial Pressure—

Typical oxide semiconductors have a characteristic that its conductivity can be controlled with the amount of oxygen (deficit amount of oxygen) in its oxide semiconductor without doping any impurities. The amorphous oxide semiconductor described in the present invention also has the same characteristic. This characteristic indicates that the conductivity of the amorphous oxide semiconductor can be controlled only with the flow quantity of oxygen (oxygen partial pressure) during film formation. From the perspective of controlling electron transportability of the intermediate layer, the flow quantity of oxygen is important as a condition for film formation.

The percentage of oxygen gas introduced during film formation varies depending on an apparatus used and the aftermentioned other conditions, however, in general it is preferably 0.05% by volume to 20% by volume, and more preferably 0.1% by volume to 15% by volume relative to the total flow quantity of oxygen. When the percentage of oxygen gas is higher than 20% by volume, the carrier concentration of the formed amorphous oxide semiconductor becomes excessively low, thereby possibly leading to an excessively low electron conductivity.

—Distance between Target and Substrate (Support)—

It is known that the amount of oxygen (deficit amount of oxygen) in a formed amorphous oxide semiconductor is changed by changing a distance between a target and a substrate (support). In general, when the distance between a target and a substrate is made longer, the deficit amount of oxygen is reduced, and the formed amorphous oxide semiconductor becomes a resistor having high-resistivity. When the distance therebetween is made shorter, it is sometimes difficult to form a uniform film due to an increase in temperature of the substrate (support) by a plasma formed on the target and due to the influence of the plasma itself exerted upon the amorphous oxide semiconductor. Thus, a film for amorphous oxide semiconductor should be formed with regard to the distance between a target and a substrate. The distance between a target and a substrate varies depending on the film formation method, apparatus and other film forming conditions, and thus it is advisable to select a distance by which desired electric properties can be obtained.

—Temperature of Substrate (Support)—

In the sputtering treatment, the substrate (support) is easily increased in temperature by electric discharge from the surface of a target. It has been known that an increase in temperature of a substrate has an influence upon the electric property, denseness, structure and the like of the formed film. Therefore, it is preferred to control the temperature of the substrate (support) by cooling, or making the distance between the target and the substrate (support) longer, or other method.

—Film Quality of Amorphous Oxide Semiconductor—

In order for an electrophotographic photoconductor to exhibit superior electrophotographic properties in the present invention, it is necessary to give consideration to the film quality of the amorphous oxide semiconductor.

In the present invention, the intermediate layer is a uniform amorphous film. Whether the film formed over a substrate (support) by the above-mentioned method is amorphous can be determined by analyzing its crystal structure of the film by an X-ray diffraction method. Besides theses methods, it may be determined by a structure analysis method such as electron analysis, neutron analysis etc. or by means of a device for observing microstructures of a cross-sectional face of the formed film such as transmission electron microscope (TEM).

Further, as characteristics of the amorphous oxide semiconductor affecting the electrophotographic properties, the film composition and the distribution of the film composition are important. As an analyzing method of the composition of an amorphous oxide semiconductor, a commonly used analyzing method of elements can be employed. Examples of the method include analyzing methods of constituents of a matter, such as fluorescent X-ray analysis, X-ray photoelectron spectroscopy, Auger electron spectroscopy, and energy dispersive X-ray spectroscopy.

The electric properties of an amorphous oxide semiconductor used for the intermediate layer greatly affect the electric properties of the formed electrophotographic photoconductor. Thus, to obtain desired electric properties of an electrophotographic photoconductor to be produced, there is a need to suitably select electric properties of an amorphous oxide semiconductor to which the intermediate layer is applicable. Typical electric properties of amorphous oxide semiconductors are explained below.

—Carrier Concentration—

In the amorphous oxide semiconductor, the deficit amount of oxygen (so-called carrier concentration) in the film can be controlled with the flow quantity of oxygen, without doping metal impurities. Also, the carrier concentration can be controlled by doping impurities as appropriate.

As methods of determining the quantity of the carrier concentration, generally, for example, methods of utilizing Hall effect are exemplified.

—Surface Resistivity—

A method of measuring the surface resistivity of the amorphous oxide semiconductor is not particularly limited and a commonly used surface resistivity measuring method may be used. Specifically, as to resistors having a low-surface resistivity of $10^6$ Ω/cm$^2$ or lower, constant-current application methods as described in JIS K 7194 and the like are exemplified. As to resistors having a high-surface resistivity of $10^6$ Ω/cm$^2$ or higher, constant-current application-leakage current measurement methods as described in JIS K 6911 and the like are exemplified. Besides the above methods, a surface resistivity of the amorphous oxide semiconductor may be measured by a commonly known method such as four-point probe method, four-terminal method, and two-terminal method.

—Band Gap—

In the present invention, the band gap of the amorphous oxide semiconductor is also deemed to relate to properties of the electrophotographic photoconductor, in particular, to hole blocking property resulting from the support. Thus, a band gap (accurately, a work factor of the filled band of the amorphous oxide semiconductor) may be suitably selected so that superior hole blocking property can be obtained.

The band gap of the amorphous oxide semiconductor can be measured by electrochemical measurement method, photochemical measurement method or the like. For example, a band gap energy measurement method using a Tauc plot, which is one of photochemical measurement methods, is exemplified. As for this method, in general, in a region having a relatively large optical absorptivity near an optical absorption edge at a longer wavelength of a semiconductor, the following equation is viable among an optical absorption coefficient α, an optical energy hν (where h represents a Planck's constant, and ν represents a wave number), and a band gap energy E0.

$$\alpha h\nu = B(h\nu - E0)^2 \text{ (where } B \text{ is a constant.)}$$

Therefore, an optical spectrum is measured, and a value of hν is plotted against a value of $(\alpha h\nu)^{1/2}$ (so-called Tauc plot), a tangent is extrapolated in the resultant plot values, and a value of hν obtained in the equation, α=0, is a band gap energy.

The band gap is not particularly limited and may be measured using the method described above, or when a property value that can be expressed electrochemically and photochemically can be obtained, various measurement methods are usable.

—Thickness of Intermediate Layer—

The thickness of an amorphous oxide semiconductor used for the intermediate layer is also deemed to affect electric properties of an electrostatic photoconductor. At the present time, light sources widely used in exposure processes are highly coherent laser beams, and thus moiré easily occurs due to the interference between an incident laser beam and reflected light from a support or the like, and the surface of a support often has predetermined convexo-concave portions for the purpose of compensating a physical contact between a support and an intermediate layer. In this case, when the intermediate layer is thin in thickness, a film thickness deviation increases due to convexo-concave portions formed on the surface of a support, thereby possibly causing a partial charge failure. Meanwhile, when an amorphous oxide semiconductor is used for an intermediate layer as in the present invention, the use of an excessively thick intermediate layer causes an increase in variation of its composition in its film depth direction, thereby a locational variation in electric properties occurs, and it requires long time in film formation, resulting in a significant increase in cost. Thus, the use of such an excessively thick intermediate layer is not practical.

The thickness of the intermediate layer is preferably 0.05 μm to 1.5 μm, and more preferably 0.1 μm to 0.9 μm. When the thickness of the intermediate layer is less than 0.05 μm, it is difficult to uniformly coat the support surface, and thereby the effects of the present invention may not be exhibited. When the thickness is more than 1.5 μm, the cost incurred for film formation increases excessively, and there is a possibility that electric properties of the intermediate layer vary between a position near the support and a position near the photosensitive layer.

—Layer Structure of Electrophotographic Photoconductor—

The electrophotographic photoconductor of the present invention has a support, and at least an intermediate layer and a thermosensitive layer laid in this order on the support.

The photosensitive layer may take a single-layer structure or a multi-layered structure, provided that the layer has a charge generating layer and an electron transporting layer. By way of example, aspects of the photosensitive layer are illustrated with reference to FIGS. 1 to 3.

The schematic cross-sectional view of FIG. 1 showing an electrophotographic photoconductor is one example of a single-layer type photosensitive layer, in which an intermediate layer 32 and a photosensitive layer 36 containing a charge generating material and a charge transporting material as main components are formed over a support 31.

Figure 2:
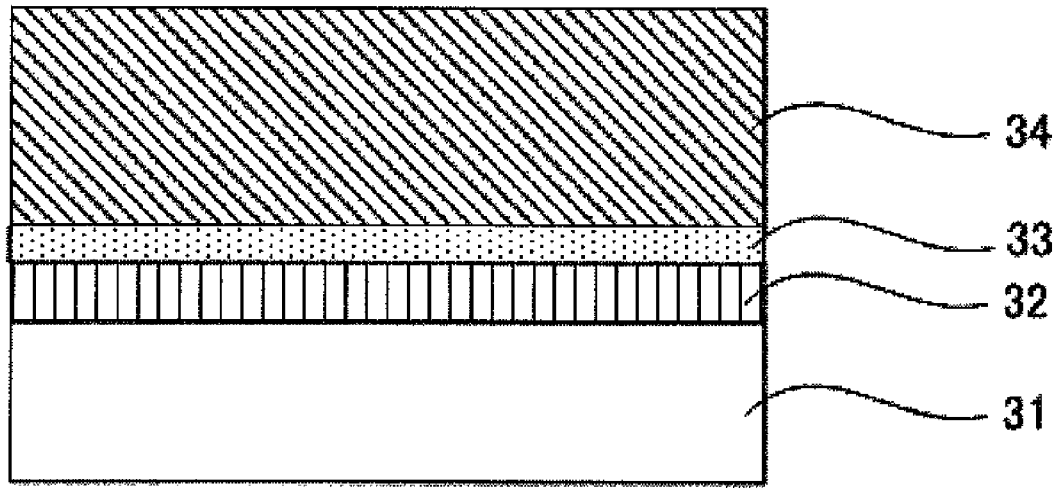
FIG. 2 is a schematic cross-sectional view showing yet another example of a layer structure of an electrophotographic photoconductor of the present invention.
Figure 3:
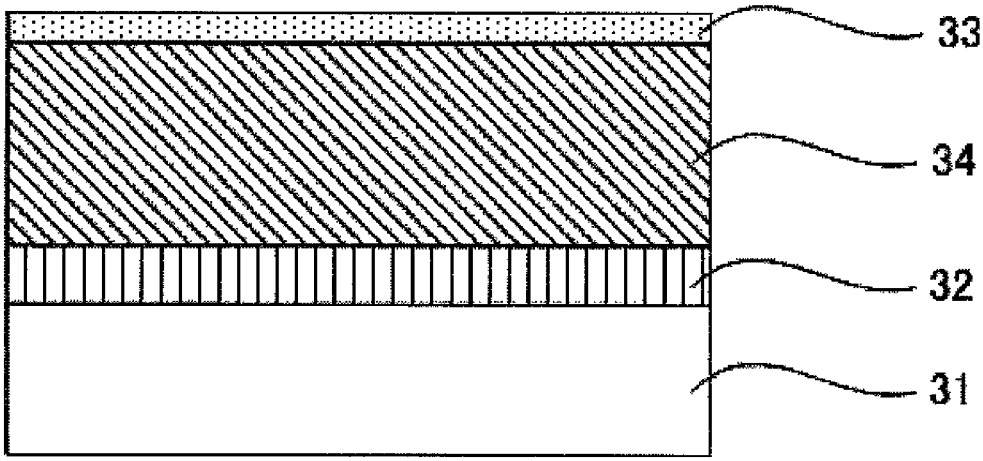
FIG. 3 is a schematic cross-sectional view showing yet another example of an electrophotographic photoconductor of the present invention.

The schematic cross-sectional views of FIG. 1 and FIG. 2 each showing an electrophotographic photoconductor are examples of a multi-layered type photosensitive layer, and each show an aspect in which a charge generating layer 33 serving a charge generation function and a charge transporting layer 34 are separately formed over a support and an intermediate layer 32. When a photosensitive layer takes this aspect, the order of forming a charge generating layer and a charge transporting layer is not particularly limited as illustrated in these figures, and may be suitably selected in accordance with the intended use.

<Multi-Layered Type Photosensitive Layer>

In the multi-layered type photosensitive layer, individual layers serve a charge generation function and a charge transporting function, i.e. the photosensitive layer has a layer structure in which a charge generating layer and a charge transporting layer are stacked over at least a support. The order of forming these layers is not particularly limited. Most of charge generating materials are lack in chemical stability, and when exposed to an acid gas like an electric discharge product in a periphery of a charger in electrophotographic image-formation process, a reduction in charge generating effect or the like is induced. For this reason, it is preferred to stack a charge transporting layer on a charge generating layer.

—Charge Generating Layer—

The charge generating layer contains a charge generating material having a charge generation function as a main component, and when necessary, a binder resin can be additionally used.

For the charge generating material, inorganic materials and organic materials can be used.

The inorganic materials are not particularly limited and may be suitably selected in accordance with the intended use. Examples thereof include crystalline selenium, amorphous selenium, selenium-tellurium, selenium-tellurium-halogen, selenium-arsenic compounds, and amorphous silicon. As the amorphous silicone, a dangling-bond terminated with a hydrogen atom or halogen atom, and a dangling-bond doped with a boron atom or phosphorous atom are suitably used.

The organic materials are not particularly limited and may be suitably selected from among conventionally known materials in accordance with the intended use. Examples thereof include phthalocyanine pigments such as metal phthalocyanine, and metal-free phthalocyanine; azlenium salt pigments, squaric acid methine pigments, azo pigments having a carbazole skeleton, azo pigments having a triarylamine skeleton, azo pigments having a diphenylamine skeleton, azo pigments having a dibenzothiophene skeleton, azo pigments having a fluorenon skeleton, azo pigments having oxadiazole skeleton, azo pigments having a bisstilbene skeleton, azo pigments having a distyryloxadiazole skeleton, azo pigments having a distyrylcarbazole skeleton, perylene pigments, anthraquinone or polycyclic quinine pigments, quinonimine pigments, diphenylmethane and triphenylmethane pigments, benzoquinon and naphthoquinone pigments, cyanine and azomethine pigments, indigoid pigments, and bisbenzimidazole pigments. These charge generating materials may be used alone or in the form of mixture of two or more.

In the present invention, among the above-mentioned charge generating materials, in particular, phthalocyanine pigments are preferable, because it is recognized that superior electrophotographic properties can be maintained for a long period of time. The reason for this is not yet clearly known, however, it is considered because phthalocyanine pigments hardly interact with the amorphous oxides described in the present invention.

As for the phthalocyanine pigments, metal-free phthalocyanines or metal phthalocyanines are exemplified as mentioned above, and those obtained by the synthesis methods described in "Phthalocyanine Compounds" by Moser and Thomas (Rheinhold Publishing Company 1963) or other appropriate methods can be used.

Examples of the metal phthalocyanines include those having as a central metal, copper, silver, beryllium, magnesium, calcium, zinc, indium, sodium, lithium, titanium, tin, lead, vanadium, chrome, manganese, iron, cobalt, etc. Further, in the central nucleus of phthalocyanine, a halogenated metal having trivalent or higher polyvalence may be present, instead of the metal atom. It should be noted that various types of phthalocyanine crystal form are known, and conventionally known phthalocyanine of crystal forms such as α-type, β-type, Y-type, ε-type, τ-type, X-type and the like and phthalocyanines of amorphous forms can be used.

Further, in the present invention, titanylphthalocyanine having titanium as a central metal as illustrated by the following General Formula (A) (hereinbelow, sometimes referred to as TiOPc) is particularly desired for its capability of exhibiting higher sensitivity and superior properties. Of these, R-type titanylphthalocyanine is preferable.

General Formula (A)

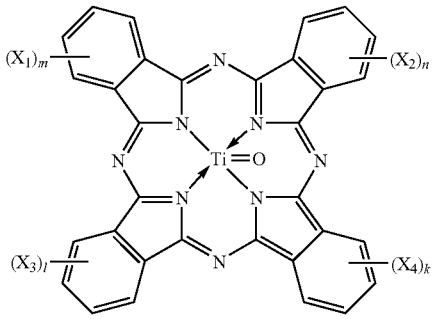

In General Formula (A), $X_1$, $X_2$, $X_3$ and $X_4$ represent various types of halogen atom, and n, m, l, and k each represent an integer of 0 to 4.

As the titanylphthalocyanine, titanylphthalocyanine having a maximum diffraction peak at a Bragg angle of (2θ±0.2°) 27.2° and a minimum diffraction peak at 7.3° in an X-ray diffraction spectrum with CuKα radiation (wavelength: 1.542 Å) is highly effective in terms of its capability of high-sensitivity of the resultant electrophotographic photoconductor and exhibiting stable photosensitivity over a long term even used in combination with the intermediate layer composed of an amorphous oxide.

From the viewpoint of providing high-sensitivity to the resultant photoconductor, it is desired to make the particle size of a phthalocyanine pigment smaller. The reasons are explained as follows: most of photocarriers generated inside the charge generating material particles are more unlikely to be deactivated before they reach a carrier generating site on the surface of particle because the migration distance to the particle surface becomes shorter (an increase in photocarrier generating efficiency), and further, the total surface area of pigment particles is increased in accordance making the particles smaller in size, resulting in an increase in photocarrier introducing efficiency due to an increase in area contacting the charge transporting material surrounding the surface of pigment particles. It is considered that owing to the above-mentioned actions of a phthalocyanine pigment having a small average diameter, the photosensitivity of the resultant photoconductor can be increased. The average particle diameter of the phthalocyanine pigment is preferably 0.6 μm or less, and more preferably 0.4 μm or less.

The measurement method of the average diameter of a phthalocyanine pigment is not particularly limited, and a conventionally known method may be used. Examples of the method include centrifuge separation method, laser diffraction method, dynamic light scattering method, and electrically detecting method. In the present invention, the average diameter (Median particle diameter) of a phthalocyanine pigment is a volume average particle diameter corresponding to 50% of a cumulative distribution that is measured by a ultracentrifugal automatic particle size distribution measurement device (CAPA-700, manufactured by HORIBA Ltd.).

The binder resin is not particularly limited and may be suitably selected in accordance with the intended use. Examples thereof include polyamides, polyurethanes, epoxy resins, polyketones, polycarbonates, silicone resins, acrylic resins, polyvinylbutylals, polyvinylformals, polyvinylketones, polystyrenes, poly-N-vinylcarbazoles, polyacrylamides, polyvinylbenzals, polyesters, phenoxy resins, vinyl chloride-vinyl acetate copolymers, polyvinyl acetates, polyphenylene oxides, polyvinyl pyridines, cellulose resins, caseins, polyvinyl alcohols, and polyvinyl pyrrolidones. These binder resins may be used alone or in the form of mixture of two or more.

The amount of the binder resin is preferably 500 parts by mass or less, and more preferably 10 parts by mass relative to 300 parts by mass relative to 100 parts by mass of the charge generating material. Note that the binder resin may be added to the charge generating material before or after the dispersion.

The method of forming a charge generating layer is broadly classified into two types, i.e., vacuum thin film forming method and casting method. As the former method, vacuum deposition method, glow discharge decomposition method, ion-plating method, sputtering method, reactive sputtering method, CVD method can be used, and the former method allows a user to efficiently form the above-mentioned inorganic materials and organic materials. In the meanwhile, to form a charge generating layer by the latter method, i.e., casting method, the inorganic or organic charge generating material is dispersed along with the binder resin when necessary, in a solvent such as tetrahydrofuran, dioxane, dioxolan, toluene, dichloromethane, monochlorobenzene, dichloroethane, cyclohexanone, cyclopentanone, anisole, xylene, methylethylketone, acetone, ethyl acetate, butyl acetate, by means of a ball mill attritor, sand mill, bead mill or the like, the thus obtained dispersion liquid is suitably diluted, the diluent is applied onto a surface, thereby forming a charge generating layer. When necessary, the after-mentioned leveling agent may be also added to the dispersion liquid. The diluted dispersion liquid can be applied by a dip coating method, spray coating method, bead-coating method, ring-coating method, or the like.

The thickness of the charge generating layer is preferably 0.01 μm to 5 μm, and more preferably 0.05 μm to 2 μm.

—Charge Transporting Layer—

The charge transporting layer is a layer that has a charge transportation function and is primarily composed of a charge transporting material or polymeric charge transporting material, and a binder resin.

The binder resin is not particularly limited and may be suitably selected from conventionally known materials in accordance with the intended use. Examples thereof include thermoplastic or thermosetting resins such as polystyrenes, styrene-acrylonitrile copolymers, styrene-butadiene copolymers, styrene-maleic anhydride copolymers, polyesters, polyvinyl chlorides, vinyl chloride-vinyl acetate copolymers, polyvinyl acetates, polyvinylidene chlorides, polyacrylate resins, phenoxy resins, polycarbonates, cellulose acetate resins, ethyl cellulose resins, polyvinylbutylals, polyvinylformals, polyvinyltoluenes, poly-N-vinylcarbazoles, acrylic resins, silicone resins, epoxy resins, melamine resins, urethane resins, phenol resins, and alkyd resins.

The charge transporting material is not particularly limited and may be suitably selected in accordance with the intended use. Examples thereof include conventionally known positive hole transporting materials having a positive hole transporting structure, such as triarylamines, hydrazones, pyrazolines, and carbazoles; and conventionally known electron transporting materials having an electron transporting structure such as condensed polycyclic quinones, diphenoquinones, and an electron attractive aromatic ring having a cyano group or nitro group. These positive hole transporting materials and electron transporting materials may be used alone or in the form of mixture of two or more.

The amount of the charge transporting material contained in the charge transporting layer is preferably 20% by mass to 80% by mass, and more preferably 30% by mass to 70% by mass relative to the total mass of the charge transporting layer. When the amount of the charge transporting material contained in the charge transporting layer is less than 20% by mass, the charge transportability of the charge transporting layer is reduced, and thereby desired light attenuation properties may not be obtained. When it is more than 80% by mass, the photoconductor surface is abraded more than necessary due to various hazards experienced by the photoconductor in electrophotographic process. Meanwhile, the amount of the charge transporting material contained in the charge transporting layer is within the more preferred range, it is advantageous in that desired light attenuation properties can be obtained and an electrophotographic photoconductor causing less abrasion amount can be obtained even under long time use.

The polymeric charge transporting material is a material having both the after-mentioned functions of a binder resin and a charge transporting material. In particular, when the amorphous oxide described in the present invention is used for an intermediate layer, it has been known from the extensive studies and examinations carried out by the present inventors that reduction in chargeability and occurrence of background smear can be prevented by using a polymeric charge transporting material as the charge transporting material. Thus, it is preferred to use a polymeric charge transporting material.

The polymeric charge transporting material is not particularly limited, may be suitably selected from conventionally known materials, however, it is preferred that the polymeric charge transporting material is at least one polymer selected from the group consisting of polycarbonates, polyurethanes, polyesters and polyethers. In particular, polycarbonates having a triarylamine structure in at least one of its main chain and its side chain, as exemplarily disclosed in Japanese Patent (JP-B) Nos. 3852812 and 3990499 are preferable from the perspective of abrasion resistance and charge transportability The polymeric charge transporting materials may be used alone or in combination. Further, from the perspective of abrasion resistance and film formability, the after-mentioned binder resin may be additionally used therewith. When the polymeric charge transporting material is used along with the binder in view of satisfying charge transportability in addition to the above-noted physical properties, the amount of the polymeric charge transporting material is preferably 40% by mass to 90% by mass, and more preferably 50% by mass to 80% by mass relative to the total mass of the charge transporting layer.

The charge transporting layer is formed as follows. The charge transporting material and the binder resin or the polymeric charge transporting material are dissolved and/or dispersed in an appropriate solvent, the resultant liquid is applied onto a target surface and dried, thereby a charge transporting layer can be formed.

Most of the components constituting the charge transporting layer are solid under normal temperature and normal pressure, and thus in the preparation of a charge transporting layer coating liquid, a solvent having high affinity for these components is used. The solvent used in this step is not particularly limited as long as it is a conventionally used solvent for coating. A solvent may be used or two or more solvents may be used in the form of mixture.

The coating method employed in the formation of a charge transporting layer is not particularly limited, and may be suitably selected from among commonly used coating methods in view of the viscosity of a resultant coating liquid, the thickness of the desired charge transporting layer, and the like. For instance, dip coating method, spray coating method, bead coating method, and ring coating method are exemplified.

Also, when necessary, the after-mentioned plasticizers and leveling agents may be added to the charge transporting layer.

The thickness of the charge transporting layer is preferably 50 μm or less, and more preferably 45 μm or less in terms of the resolution and responsibility. The lower limit thickness of the charge transporting layer varies depending on the system used (particularly, depending on charge potential, etc.), but it is preferably 5 μm or more.

From the perspective of electrophotographic properties and film viscosity, the charge transporting layer formed by the above-mentioned method should be heated by means of some sort of unit so as to remove the solvent therefrom. The charge transporting layer can be heated from the coated surface or the support surface using air, gas such as nitrogen gas, steam, various heating media, infrared ray, or electromagnetic wave.

The heating temperature is preferably 100° C. to 170° C. When the heating temperature is lower than 100° C., it is confirmed that the organic solvent in the charge transporting layer cannot be sufficiently removed, resulting in a degradation of electrophotographic properties and a degradation of abrasion resistance. When the charge transporting layer is heated at a temperature higher than 170° C., the layer surface may have orange peel-like appearance or have cracks and may be delaminated at the interface with the adjacent layer. When volatile components in the photosensitive layer disappear outside, it is unfavorable because desired electric properties cannot be obtained.

<Single-Layer Type Photosensitive Layer>

A single-layer structured photosensitive layer simultaneously has a charge generating function and a charge transporting function. The photosensitive layer can be formed by dissolving and/or dispersing a charge generating material, a charge transporting material and a binder resin in an appropriate solvent, applying the thus prepared coating liquid onto a target surface and drying the applied coating liquid. Further, when necessary, a plasticizer, a leveling agent, an antioxidant and the like can be added to the coating liquid.

As the binder resin, any of the binder resins mentioned in the section of "charge generating layer" can be used in combination with the aforementioned binder resins mentioned in the section of "charge transporting layer" in the form of mixture. Note that the polymeric charge transporting material can also be used suitably. The amount of the charge generating material included per 100 parts by mass of the binder resin is preferably 5 parts by mass to 40 parts by mass, and the amount of the charge transporting material included per 100 parts by mass of the binder resin is preferably 190 parts by mass or less, and more preferably 50 parts by mass to 150 parts by mass.

More specifically, the single-layer type photosensitive layer can be formed as follows. The charge generating material and the binder resin are dispersed together with the charge transporting material in a solvent such as tetrahydrofuran, dioxane, dichloroethane or cyclohexane using a dispersing device to prepare a coating liquid, and the coating liquid is applied onto a target surface by a dip coating method, spray coating method, bead-coating method or ring coating method.

The thickness of the single-layer type photosensitive layer is preferably 5 μm to 25 μm.

<Surface Layer>

As described at the outset, with a view toward improving durability against various mechanical and electrical hazards experienced by a electrophotographic photoconductor in image formation process and providing longer life to the electrophotographic photoconductor, a surface layer may be formed on the photosensitive layer surface. Examples of the layer structure are explained below with reference to FIGS. 4 to 6.

Figure 4:
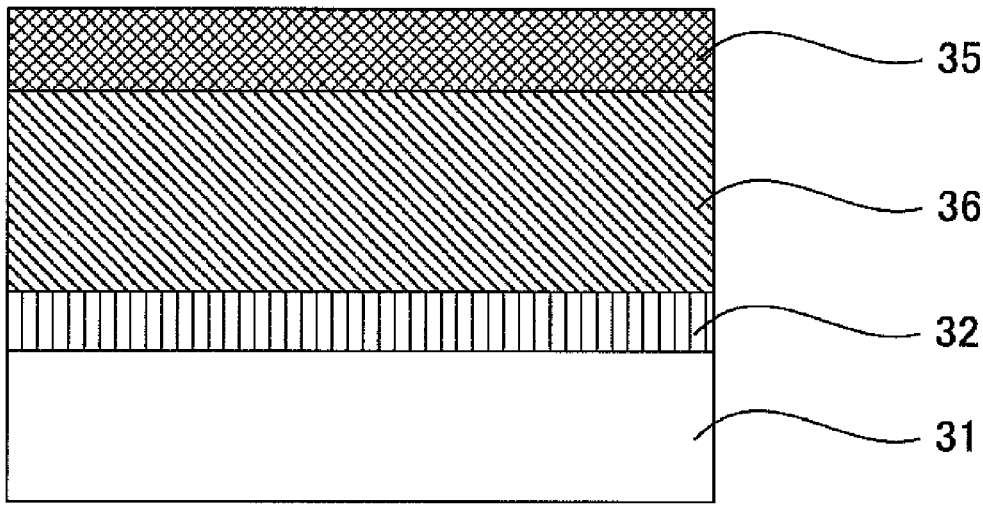
FIG. 4 is a schematic cross-sectional view showing yet another example of a layer structure of an electrophotographic photoconductor of the present invention.

The schematic cross-sectional view of electrophotographic photoconductor of FIG. 4 illustrates one example of an electrophotographic photoconductor having a single-layer photosensitive layer. Over a support 31 and an intermediate layer 32, a photosensitive layer 36 primarily composed of a charge generating material and a charge transporting material and a surface layer 35 are provided. Note that the surface layer 35 is a cross-linked surface layer as described below.

Figure 5:
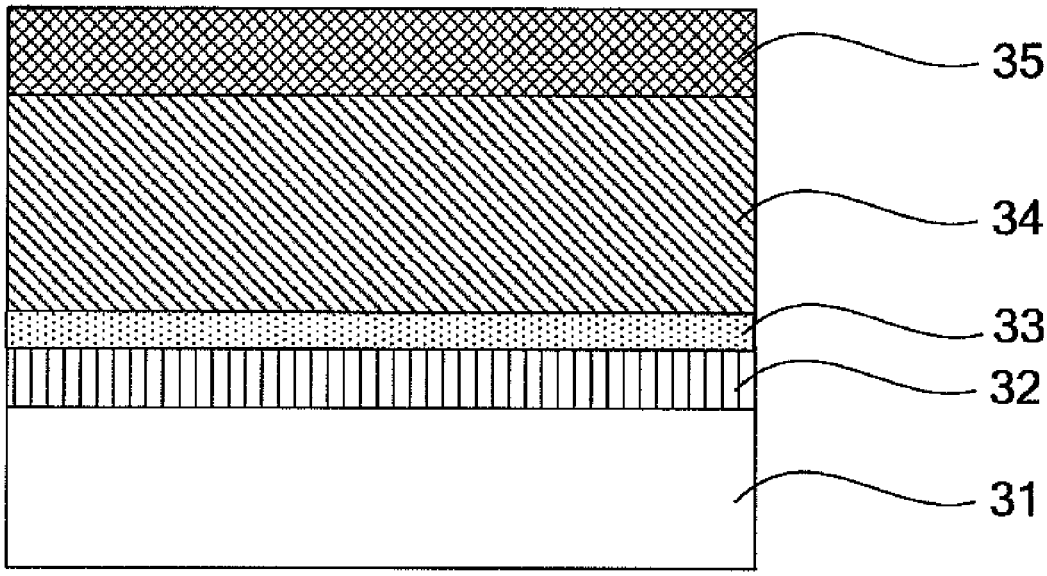
FIG. 5 is a schematic cross-sectional view showing yet another example of a layer structure of an electrophotographic photoconductor of the present invention.
Figure 6:
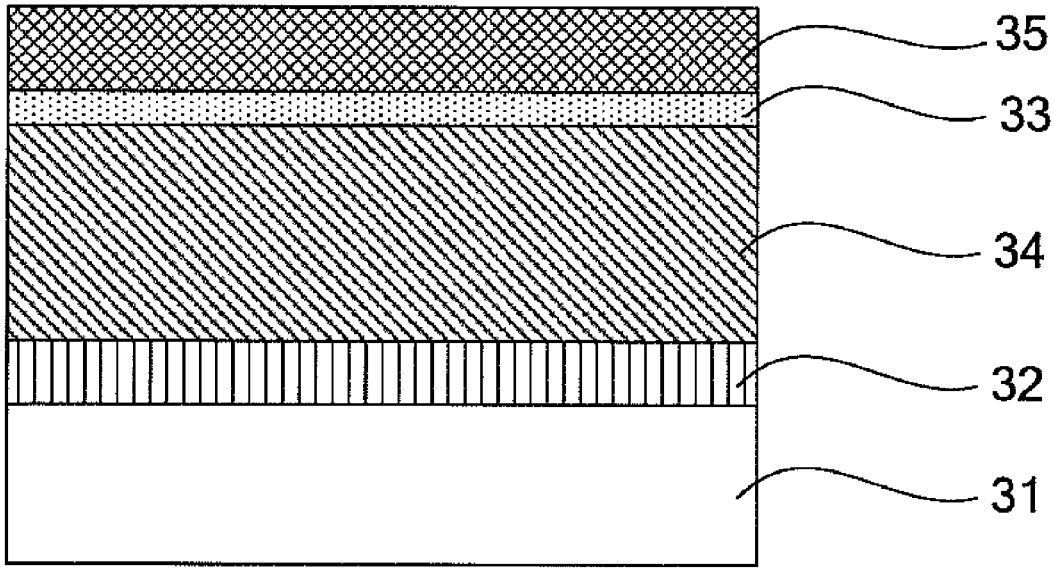
FIG. 6 is a schematic cross-sectional view showing still yet another example of a layer structure of an electrophotographic photoconductor of the present invention.

The schematic cross-sectional views of electrophotographic photoconductor of FIGS. 5 and 6 illustrate examples of an electrophotographic photoconductor having a multi-layered photosensitive layer, and respectively show an aspect of layer structure in which a charge generating layer 33 having a charge generating function and a charge transporting layer 34 having a charge transporting function are separately stacked over a support 31 and an intermediate layer 32. When an electrophotographic photoconductor takes this layer structure, the stacking order of the charge generating layer and the charge transporting layer is not particularly limited as illustrated in the figures, and both of the layer stacking orders can be used in accordance with the intended use. As the outermost surface layer of the electrophotographic photoconductor, a surface layer 35 is formed.

The surface layer contains at least a radically polymerizable compound and a photo-radical polymerization initiator and is a cross-linked surface that can be obtained by exposing the layer surface to light using a light irradiation unit so as to be polymerized.

—Radically Polymerizable Compound—

As the radically polymerizable compound, a radically polymerizable compound having no charge transporting structure may be used alone, or a radically polymerizable compound having a charge transporting structure may be used alone or both of these compounds may be used in combination. When a radically polymerizable compound having no charge transporting structure is used alone as the radically polymerizable compound, it is preferable to additionally use a charge transporting material having no radical polymerizable functional group for the purpose of providing a charge transporting function to the surface layer. Note that the charge transporting material having no radical polymerizable functional group indicates the charge transporting material described in the section of "charge transporting layer". Further, various additives described below may be also added to the radically polymerizable compound for the purpose of providing other functions to the surface layer.

As the radical polymerizable functional group, 1-substituted ethylene functional group and 1,1-substituted ethylene functional group described below are exemplified.

(1) Examples of the 1-substituted ethylene functional group include functional groups represented by the following General Formula (1).

$$CH_2{=}CH{-}X_1{-} \qquad \text{General Formula (1)}$$

In General Formula (1), $X_1$ represents a phenylene group that may have a substituent, an allylene group such as naphthylene group, an alkenylene group that may have a substituent, —CO— group, —COO-group, —CON($R^{10}$)-group ($R^{10}$ represents a hydrogen atom, an alkyl group such as a methyl group and an ethyl group; an aralkyl group such as a benzyl group, a naphthylmethyl group, and a phenetyl group; or an aryl group such as a phenyl group and a naphthyl group), or an S-group.

Specific examples of the substituents are vinyl group, styryl group, 2-methyl-1,3-butadienyl group, vinylcarbonyl group, acryloyloxy group, acryloylamide group, and vinylthioether group.

(2) Examples of the 1,1-substituted ethylene functional group include functional groups represented by the following General Formula (2).

$$CH_2{=}C(Y){-}X_2{-} \qquad \text{General Formula (2)}$$

In General Formula (2), Y represents an alkyl group that may have a substituent, an aralkyl group that may have a substituent, a phenyl group that may have a substituent, an aryl group such as a naphthyl group; a halogen atom, a cyano group, a nitro group, an alkoxy group such as a methoxy group or an ethoxy group; —$COOR_{11}$ group ($R_{11}$ represents a hydrogen atom, an alkyl group that a methyl group that may have a substituent, an alkyl group like a methyl group or an ethyl group that may have a substituent, an aralkyl group like a benzyl group or a phenethyl group that may have a substituent, a phenyl group that may have a substituent or an aryl group such as a naphthyl group), or $CONR_{12}R_{13}$ ($R_{12}$ and $R_{13}$ each represent a hydrogen atom, an alkyl group like a methyl group or an ethyl group that may have a substituent, an aralkyl group like a benzyl group, a naphthylmethyl group or a phenethyl group that may have a substituent, or an aryl group like a phenyl group or a naphthyl group that may have a substituent, and they are identical to or different from each other).

Further, $X_2$ represents the same substituent as that of $X_1$, a single bond or an alkylene group. It should be noted that at least one of Y and $X_2$ is an oxycarbonyl group, a cyano group, an alkenylene group or an aromatic ring.

Examples of the substituent include α-acryloyloxy chloride group, methacryloyloxy group, α-cyanoethylene group, α-cyanoacryloyloxy group, α-cyanophenylene group, and methacryloylamino group.

As substituents that are further substituted by any of these substituents of $X_1$, $X_2$ and Y, a halogen atom, a nitro group, a cyano group, an alkyl group such as a methyl group and an ethyl group; and alkoxy group such as a methoxy group and an ethoxy group; an aryloxy group such as phenoxy group; an aryl group such as a phenyl group and a naphthyl group; and an aralkyl group such as a benzyl group and a phenethyl group are exemplified.

Among these radical polymerizable functional groups, acryloyloxy group and methacryloyloxy group are especially useful.

—Radically Polymerizable Compound having No Charge Transporting Structure—

The radically polymerizable compound having no charge transporting structure used in the present invention indicates a compound that does not have a hole transporting structure such as triarylamine, hydrazone, pyrazoline, and carbazole nor does it have an electron transporting structure such as an electron-attracting aromatic ring having condensed polycyclic quinone, diphenoquinone, cyano group or nitro group, and does have a radical polymerizable functional group. This radical polymerizable functional group is not particularly limited as long as it is any one of the radical polymerizable functional group described above.

In the present invention, the number of functional groups of the radically polymerizable compound is not particularly limited, however, in order to impart abrasion resistance to the surface layer, it is preferable to use at least one type of radically polymerizable compound having three or more radical polymerizable functional groups. When only a monofunctional or bifunctional radically polymerizable compound is used, a crosslinking bond in the surface layer is sparsely formed, and a dramatic improvement in abrasion resistance may be sometimes difficult to achieve. However, when only a trifunctional or higher radically polymerizable compound is used, a degradation in surface smoothness may occur due to an increase in viscosity of the coating liquid, and failure of cracks may occur due to volume shrinkage of the surface layer during curing reaction, and thus one type or more radically polymerizable oligomer may be additionally used with monofunctional to bifunctional radically polymerizable compounds with a view towards adjusting the viscosity of the coating liquid, maintaining the surface smoothness of the surface layer, preventing occurrence of cracks due to crosslinking shrinkage and reducing the surface free energy of the surface layer.

—Radically Polymerizable Compound having Charge Transporting Structure—

The radically polymerizable compound having a charge transporting structure used in the present invention indicates a compound having a hole transporting structure such as triarylamine, hydrazone, pyrazoline, and carbazole, for instance, an electron transporting structure such as an electron attracting aromatic ring having a condensed polycyclic quinone, diphenoquinone, cyano group or nitro group, and has radical polymerizable functional groups. The radical polymerizable functional groups are not particularly limited as long as they are the above-noted radically polymerizable functional groups.

In the present invention, the number of functional groups of the radically polymerizable compound is not particularly limited, however, it is desired that in order for the electrophotographic photoconductor to maintain superior electric properties over a long period of time, the number of radical polymerizable functional groups be 1 (one). When a bifunctional or higher charge transporting compound is used as a main component, sites having a charge transporting structure are fixed by a plurality of bonds in the crosslinked structure. Therefore, during transportation of charge, an intermediate structure (cation radical) cannot be stably held, resulting in easy occurrence of degradation in photosensitivity and an increase in residual potential due to charge trapping. These degradations in electric properties may cause adverse phenomena such as degradation in image density, and thinning of characters.

As the charge transporting structure, triarylamine structure is highly effective. Further, when a compound having a structure represented by the following General Formulas (I) or (II) is used, electric properties such as photosensitivity and residual potential can be efficiently maintained.

General Formula (II)

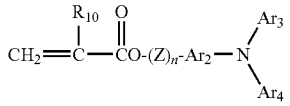

General Formula (I)

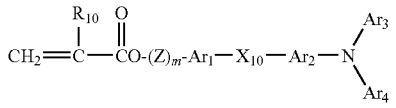

In General Formulas (1) and (II), $R_{10}$ represents a hydrogen atom, a halogen atom, a substituted or unsubstituted alkyl group, a substituted or unsubstituted aralkyl group, a substituted or unsubstituted aryl group, cyano group, nitro group, alkoxy group, —$COOR_{11}$ ($R_{11}$ represents a hydrogen atom, a substituted or unsubstituted alkyl group, a substituted or unsubstituted aralkyl group or a substituted or unsubstituted aryl group), a halogenated carbonyl group or $CONR_{12}R_{13}$ ($R_{12}$ and $R_{13}$ may be identical to or different from each other and each represent a hydrogen atom, a halogen atom, a substituted or unsubstituted alkyl group, a substituted or unsubstituted aralkyl group or a substituted or unsubstituted aryl group). $Ar_1$ and $Ar_2$ may be identical to or different from each other and each represent a substituted or unsubstituted allylene group. $Ar_3$ and $Ar_4$ may be identical to or different from each other and each represent a substituted or unsubstituted aryl group. $X_{10}$ represents a single bond, a substituted or unsubstituted alkylene group, a substituted or unsubstituted cycloalkylene group, a substituted or unsubstituted alkyleneether group, an oxygen atom, a sulfur atom or a vinylene group. Z represents a substituted or unsubstituted alkylene group, a substituted or unsubstituted alkyleneether group or an alkyleneoxycarbonyl group, and m and n each represent an integer of 0 to 3. As to specific compounds represented by one of the General Formulas (1) and (II), those exemplarily described in Japanese Patent (JP-B) Nos. 4145820 and 418839 can be used.

The radically polymerizable compound having a charge transporting structure used in the present invention is important to impart charge transportability to the surface layer, and the amount of this component is preferably 20% by mass to 80% by mass, and more preferably 30% by mass to 70% by mass relative to the total amount of the surface layer. When the amount of the radically polymerizable compound having a charge transporting structure is less than 20% by mass, sufficient charge transportability of the surface layer cannot be kept to sometimes cause degradation in photosensitivity when repeatedly used and degradation in electric properties such as an increase in residual potential. When the amount is more than 80% by mass, the amount of the radically polymerizable compound having no charge transporting structure is reduced, causing a decrease in crosslinking density, and consequently, high abrasion resistance cannot be attained. The proper amount of the radically polymerizable compound having a charge transporting structure cannot be unequivocally defined because the required electric properties and abrasion resistance vary depending on the process employed, however, in view of the balance of both of these properties, it is particularly preferably within the rage from 30% by mass to 70% by mass. When the radically polymerizable compound having a charge transporting structure is used in combination with the after-mentioned charge transporting material having no radical polymerizable functional group, the amount of the radically polymerizable compound and the charge transporting material is preferably 20% by mass to 80% by mass, and more preferably 30% by mass to 70% by mass relative to the total amount of the surface layer.

—Photoradical Polymerization Initiator—

The photoradical polymerization initiator is not particularly limited, and a commonly used compound may be used. Note that in order to efficiently carry out radical polymerization, a thermal polymerization initiator may be additionally used.

The photoradical polymerization initiator may be selected from commercially available photoradical polymerization initiators. The amount of the photoradical polymerization initiator contained in the radically polymerizable compound is preferably 0.5 parts by mass to 40 parts by mass, and more preferably 1 part by mass to 20 parts by mass relative to 100 parts by mass of the radical polymerizable compound.

The surface layer can be formed by applying a coating liquid containing at least the radically polymerizable compound and the photoradical polymerization initiator onto the photosensitive layer and curing the applied coating liquid. When the radically polymerizable compound in the coating liquid is liquid, it is also possible to dissolve other components in the compound and to use the obtained coating liquid for the coating treatment. In this case, the coating liquid is diluted in an organic solvent as necessary before coating treatment. The organic solvent used in this process is not particularly limited as long as it is an organic solvent commonly used for coating/printing.

The coating method employed in formation of the surface layer is not particularly limited as long as it is a commonly known coating method. It is advisable to suitably select the coating method in accordance with the viscosity of the coating liquid and desired thickness of the surface layer. For example, dip coating method, spray coating method, bead coating method and ring coating method are exemplified.

In the present invention, after applying the thus prepared coating liquid onto the photosensitive layer, the applied surface layer is cured by applying external energy to the surface layer. As the external energy used in the curing treatment, optical energy is mainly used, but thermal energy may be additionally used.

As the optical energy, mostly, it is advisable to utilize a light source such as a ultra-high pressure mercury lamp, high-pressure mercury lamp, low-pressure mercury lamp, carbon arc, and xenon arc metal halide lamp. It is more desirable that the optical energy be selected in view of the absorption properties of a radically polymerizable compound having no charge transporting structure, monofunctional radically polymerizable compound having a charge transporting structure used and a photopolymerization initiator additionally used. For the illumination intensity of the light source to be used, it is desired that the applied surface layer be exposed to an illuminance intensity of 50 $mW/cm^2$ to 2,000 $mW/cm^2$, typically, based on the wavelength of 365 nm. When the illuminance intensity is low, it takes longer time to cure the applied surface layer, and thus it is unfavorable in terms of productivity. When the illuminance intensity is high, curing shrinkage is liable to occur, and the layer surface may have orange peel-like appearance or have cracks and may be delaminated at the interface with the adjacent layer.

During the irradiation of optical energy, the temperature of the surface layer of the electrophotographic photoconductor is increased, primarily resulting from the effect of heat radiation of the light source. When the temperature of the photoconductor surface excessively increases, curing shrinkage is liable to occur on the surface layer, and low-molecular components contained in the adjacent layer transfer to the surface layer, undesirably, making it liable to cause curing inhibition of the surface layer and degradation in electric properties of the electrophotographic photoconductor. Therefore, the temperature of the photoconductor surface during irradiation of optical energy is preferably 100° C. or lower, and more preferably 80° C. or lower. As the cooling method of the photoconductor surface, a cooling auxiliary may be incorporated inside the photoconductor, or the photoconductor surface may be cooled by cooling the gas and/or liquid inside the photoconductor.

The cured surface layer may be post-heated in accordance with the necessity. For instance, a large amount of residual solvent remaining in the layer may cause degradation in electric properties and time deterioration, and thus it is preferred to volatilize the residual solvent by post-heating the cured surface layer.

The thickness of the surface layer is preferably 1 μm to 15 μm, and more preferably 3 μm to 10 μm in terms of protection of the photosensitive layer. When the surface layer is thin in thickness, the photosensitive layer cannot be protected against mechanical wear caused by a member contacting the photoconductor and by proximity discharge using a charger, surface leveling is hardly attained in the film formation, and the film (layer) surface may have orange-peel appearance. When the surface layer is thick, the entire layer thickness of the photoconductor becomes thick, undesirably, causing a degradation of reproducibility of image due to diffusion of charge.

—Other Additives—

In the electrophotographic photoconductor of the present invention, for the purpose of improving environmental resistance, especially, for the purpose of preventing a decrease in photosensitivity as well as an increase in residual potential generally commercially available antioxidant, plasticizer, lubricant, ultraviolet ray absorbent and leveling agent may be added to each of the photosensitive layer and the surface layer. The amount of these additives is suitably selected in accordance with the intended use and is preferably 0.01% by mass to 10% by mass relative to the total mass of the layer to which these additives are added.

<Support>

The support is not particularly limited as long as it can exhibit conductivity of volume resistance of $10^{10}$ Ω·cm or less, and may be suitably selected in accordance with the intended use. For example, the support may be prepared by applying a metal such as aluminum, nickel, chromium, nichrome, copper, gold, silver, or platinum or the like, or a metal oxide such as tin oxide or indium oxide or the like, for example, by vapor deposition or sputtering, onto film-form or cylindrical plastic or paper, or using a sheet of aluminum, aluminum alloy, nickel, or stainless steel or the like, and making it into a crude tube by extrusion or drawing or the like, and then surface-treating the tube by cutting, super finishing, or grinding or the like. The endless nickel belt and endless stainless belt disclosed in Japanese Patent Application Laid-Open No. 52-36016 (Published) may also be used as the support.

Besides, the surface of the support may be coated with a conductive layer coating liquid that is prepared by applying a coating liquid in which a conductive powder is dispersed in a proper binder resin. The thus prepared support can also be used in the present invention.

Examples of the conductive powder include carbon blacks, acetylene blacks, metal powder of aluminum, nickel, iron, nichrome, copper, zinc or silver, or conductive tin oxide, and metal oxide powders such as ITO. Further, examples of the binder resin used in combination include thermoplastic resins, thermosetting resins or photo-curable resins such as polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyallylate resins, phenoxy resins, polycarbonate resins, cellulose acetate resins, ethyl cellulose resins, polyvinyl butyral resins, polyvinyl formal resins, polyvinyl toluene resins, poly-N-vinyl carbazole, acrylic resins, silicone resins, epoxy resins, melamine resins, urethane resins, phenol resins, and alkyd resins.

These conductive powders and the binder resin are dispersed in a proper solvent such as tetrahydrofuran, dichloromethane, methylethylketone and toluene to prepare a coating liquid, and the coating liquid is applied onto a support surface, thereby making it possible to provide the conductive layer on the support surface.

Furthermore, a heat-shrinkable tubing in which the above-mentioned conductive powders are dispersed in a material such as polyvinyl chloride, polypropylene, polyester, polystyrene, polyvinylidene chloride, polyethylene, chlorinated rubber or Teflon® may be provided on the periphery of a cylindrical support. The thus obtained support can also be suitably used in the present invention.

As described hereinafter, a laser light source which emits a laser with high coherence is sometimes used in formation of a latent image in an electrophotographic process. As described above, supports are often made of metals, and most of them have a high surface reflectance. When an organic semiconductor material according to the present invention is used on a support having such a characteristic to produce an electrophotographic photoconductor, interference occurs between writing beam and reflected light from the support, and image defects are liable to occur. Therefore, when a support has high reflectance, it is preferred to provide convexo-concaves in the surface of the support so as to reduce the reflectance. Further, when a photosensitive layer was formed on a support, protrusions potentially existing on the support even caused image defects. A support surface having less protrusions can be provided by roughening the support surface so as to have an appropriate surface roughness. For the convexo-concaves existing in the support surface, the ten-point average surface roughness (Rz) measured by JIS B0601-1982 was used as a typical property value.

The surface roughness (Rz) was measured over an evaluation length of 2.5 mm at a reference length of 0.5 mm using SURFCOM 1400D (manufactured by TOKYO SEIMITSU CO., LTD.). As measurement sites, three points of two sites of 80 mm away from both ends of a photoconductor drum in its axial direction and a center site of the photoconductor drum were measured in fourfold at an angle of 90° in a circumferential direction, and thus 12 points in total were measured. The average value of the measurement results was regarded as a surface roughness (Rz). The surface roughness (Rz) is preferably 0.6 μm or greater. When the surface roughness (Rz) is smaller than 0.6 μm, moiré is liable to occur due to the effect of writing beam. Even when the surface roughness (Rz) is high, a silious problem is not posed in practical use, but when the value is excessively high, it needs attention because an intermediate layer is difficult to form uniformly. From this viewpoint, it is preferred that the surface roughness (Rz) of the support be 3.0 μm or smaller.

As the surface roughing method, horning treatment, and centerless grinding treatment are exemplified. The horning treatment is preferably used because it can be carried out at inexpensive cost and the surface roughness is easily controlled. The horning treatment is classified into dry-process treatment and wet-process treatment. Either treatment type may be employed. The wet-process (liquid) horning treatment is a surface roughing method in which a powdery abrasive (abrasive grain) is suspended in a liquid such as water to prepare a suspension, and the suspension is sprayed on a support surface at high speed. The surface roughness can be controlled by spraying pressure, spraying speed, the use amount, type, grain shape, grain size, degree of hardness, specific gravity of abrasive(s) or the concentration of suspension, etc. The dry-process horning treatment is a method of directly spraying a support surface with an abrasive grain at high speed, thereby surface roughing the support surface and the surface roughness can be controlled by this treatment, similarly to wet-process horning treatment. Examples of the abrasive used for these wet-process or dry-process horning treatments include particles of silicon carbide, alumina, zirconia, stainless steel, iron, glass beads, and plastic shots.

In dry-process horning treatments and liquid horning treatments using indefinitely formed alumina abrasive grains, some of the abrasive grains sometimes get stuck in support surfaces, and when the resultant electrophotographic photoconductor is used, they will appear as black spots on a white image in a reversal developing process and as white spots on a black image in a normal developing process. In liquid horning treatments using glass beads, the glass break shortly to get stack in support surfaces, and it is difficult to control the surface roughness. Thus, commonly, a support surface is roughened in a liquid horning treatment using a spherically shaped alumina abrasive grain, stainless steel abrasive grain or the like, and then an intermediate layer and a photosensitive layer are formed, thereby producing an electrophotographic photoconductor. Further, in the surface roughing treatment of a support, from the viewpoints of the treatment time, the use amount of abrasive grains, the use amount of energy, and the easiness of removing residual abrasive grains on the rough-surfaced support surface, it is preferable to carry out the surface roughing treatment under conditions as mild as possible within the range satisfying interference-preventive function to thereby reduce the surface roughness (Rz) to a minimum.

(Image Forming Method and Image Forming Apparatus)

The image forming apparatus of the present invention has at least an electrophotographic photoconductor, a charging unit, an exposing unit, a developing unit and a transfer unit, and further has other units suitably selected in accordance with the intended use, such as a fixing unit, a cleaning unit, a charge eliminating unit, a recycling unit, and a controlling unit.

The above-mentioned electrophotographic photoconductor is an electrophotographic photoconductor according to the present invention.

The image forming method used in the present invention includes at least a charging step, an exposing step, a developing step and a transfer step, and further includes other steps suitably selected in accordance with the intended use, such as a fixing step, a cleaning step, a charge eliminating step, a charge eliminating step, a recycling step, and a controlling step.

The image forming method used in the present invention can be suitably carried out by an image forming apparatus according to the present invention. More specifically, the charging step can be carried out by the charging unit, the exposing step can be carried out by the exposing unit, the developing step can be carried out by the developing unit, the transfer step can be carried out by the transfer unit, the fixing step can be carried out by the fixing unit, the cleaning step can be carried out by the cleaning unit, and the other steps can be carried out by the other units.

—Charging Step and Charging Unit—

The charging unit is not particularly limited as long as it can uniformly charge a surface of the electrophotographic photoconductor under application of a voltage, and may be suitably selected in accordance with the intended use. However, a non-contact type charging unit configured to charge an electrophotographic photoconductor surface in non-contact therewith is suitably used.

Examples of the non-contact type charging unit include needle electrode devices utilizing corona discharge, solid discharging elements; and a conductive or semiconductive charge roller disposed at a very small gap from an electrophotographic photoconductor. Among these units, corona discharge units are particularly preferable.

The corona discharge is a charging method in which a positive or negative ion generated by a corona discharge in the air is given to the surface of an electrophotographic photoconductor to charge the electrophotographic photoconductor surface in a non-contact manner. The corona discharge chargers are classified into corotron chargers having a characteristic that a constant charge amount is given to an electrophotographic photoconductor, and scorotron charges having a characteristic that a constant electric potential is given to an electrophotographic photoconductor.

The corotron charger is composed of casing electrodes occupying the half-space thereof around a discharge wire which is positioned roughly in the center of the casing electrodes.

The scorotron charger is a charger of which grid electrodes are added to the corotron charger, and the grid electrodes are positioned 1.0 mm to 2.0 mm away from the surface of an electrophotographic photoconductor.

—Exposing Step and Exposing Unit—

The exposure can be performed by imagewisely exposing the surface of the electrophotographic photoconductor using the exposing unit.

Optical systems used in the exposure are broadly classified into analog optical systems and digital optical systems. The analog optical system is an optical system of which an original document is directly projected onto an electrophotographic photoconductor through the use of an optical system. The digital optical system is an optical system in which an image is formed by giving image information as electric signals and converting the electric signals into light signals and exposing an electrophotographic photoconductor using the light signals.

The exposing unit is not particularly limited and may be suitably selected in accordance with the intended use as long as it can imagewisely expose the electrophotographic photoconductor surface that has been charged by the charging unit. Examples thereof include various exposers such as reproducing optical systems, rod lens array systems, laser optical systems, liquid crystal shutter optical systems and LED optical systems.

In the present invention, the back light method may be employed in which exposure is performed imagewisely from the back side of the photoconductor.

—Developing Step and Developing Unit—

The developing step is a step of developing the latent electrostatic image using a toner or a developer so as to form a visible image.

The visible image can be formed, for example, by developing the latent electrostatic image using a toner or developer, by means of the developing unit.

The developing unit is not particularly limited and may be suitably selected from among those known in the art as long as it can develop an image using a toner or developer. For example, a developing unit having at least a developing device which houses a toner or developer and supplies the toner or developer to the latent electrostatic image in a contact or non-contact manner is preferably exemplified.

The developing device may be of a dry-developing process or wet-developing process. It may be a monochrome color image developing device or multi-color image developing device. Preferred examples thereof include a developing device having a stirrer by which a toner or developer is frictionally stirred so as to be charged, and a rotatable magnet roller.

In the image developing device, for example, the toner and a carrier are mixed and stirred, the toner is charged by frictional force at that time to be held in a state where the toner is standing on the surface of the rotating magnet roller to thereby form a magnetic brush. Since the magnet roller is located near the electrophotographic photoconductor (photoconductor), a part of the toner constituting the magnetic brush formed on the surface of the magnet roller moves to the surface of the electrophotographic photoconductor by an electric attraction force. As the result, the latent electrostatic image is developed using the toner to form a visible toner image on the surface of the electrophotographic photoconductor.

The developer to be housed in the developing device is a developer which contains the toner, and, the developer may be a one-component developer or a two-component developer.

—Transfer Step and Transfer Unit—

The transfer step is a step of transferring the visible image onto a recording medium. According to a preferred aspect of the transfer step, the visible image is primarily transferred to an intermediate transfer member using an intermediate transfer member and then the visible image is secondarily transferred onto a recording medium. According to a more preferred aspect thereof, the transfer step includes a primary transfer step and a secondary transfer step. In the primary transfer step, two or more color toners, more preferably full-color toners are used as the toner, a formed visible image is transferred to an intermediate transfer member so as to form a composite transfer image on the intermediate transfer member. In the secondary transfer step, the composite transfer image is transferred onto a recording medium.

The transfer can be carried out, for example, by charging the electrophotographic photoconductor using a transfer-charger, i.e., the transfer unit. According to a preferred aspect of the transfer unit, it has a primary transfer unit and a secondary transfer unit. The primary transfer unit is configured to transfer the visible image to an intermediate transfer member so as to form a composite transfer image. The secondary transfer unit is configured to transfer the composite transfer image onto a recording medium.

The intermediate transfer member is not particularly limited, may be suitably selected from among those known in the art in accordance with the intended use, and preferred examples thereof include transfer belts.

The transfer unit (the primary transfer unit and the secondary transfer unit) preferably includes at least an image-transfer device that can peel-off charge the visible image formed on the electrophotographic photoconductor toward the recording medium. One transfer unit or two or more transfer units may be used. Examples of the image-transfer device include corona transfer units utilizing corona discharge electrodes, transfer belts, transfer rollers, pressure transfer rollers and adhesion transfer units.

The recording medium is typified by regular paper, however, is not particularly limited and may be suitably selected from conventional recording media, provided that developed but unfixed images can be transferred onto the recording medium. PET based recording media for OHP can also be used.

—Fixing Step and Fixing Unit—

The fixing step is a step of fixing the visible image transferred onto the recording medium using a fixing device. Fixation of the image may be carried out every time each color toner is transferred onto the recording medium or may be carried out at a time in a state where visible images of individual color toners are superimposed on the recording medium.

The fixing unit is not particularly limited and may be suitably selected in accordance with the intended use, however, in the present invention, used is a fixing unit having a fixing member and a heat source for heating the fixing member.

Examples of the fixing member include a combination of an endless belt and a roller and a combination of a roller and a roller. It is preferable to use a combination of an endless belt which is small in heat capacity, and a roller in terms of its capability of shortening the warm-up time length, realization of energy saving and enlarging a fixable width.

—Cleaning Step and Cleaning Unit—

The cleaning step is a step of removing residual toner remaining on the electrophotographic photoconductor surface, and can be carried out by means of a cleaning unit. Note that a method can also be employed whereby the charge amount of the transfer residual toner is made uniform without the use of a cleaning unit, and thereafter this transfer residual toner can be recycled by a developing roller.

The cleaning step is not particularly limited as long as it can eliminate residual toner remaining on the electrophotographic photoconductor, and may be suitably selected from among conventional cleaners. Examples thereof include magnetic brush cleaners, electrostatic brush cleaners, magnetic roller cleaners, blade cleaners, brush cleaners, and web cleaners.

—Charge Eliminating Step and Charge Eliminating Unit—

The charge eliminating step is a step of eliminating electric charge by applying a charge eliminating bias to the electrophotographic photoconductor, and can be more suitably carried out by means of a charge eliminating unit.

The charge-eliminating unit is not particularly limited as long as it can apply a charge-eliminating bias to the electrophotographic photoconductor, and may be suitably selected from among conventional charge-eliminating devices. For example, a charge-eliminating lamp or the like can be preferably used.

—Recycling Step and Recycling Unit—

The recycling step is a step of recycling the residual toner eliminated in the cleaning step to the developing unit, and suitably carried out by a recycling unit. The recycling unit is not particularly limited, and examples thereof include conventionally known conveying units.

—Controlling Step and Controlling Unit—

The controlling step is a step of controlling the individual steps described above, and suitably carried out by a controlling unit. Examples of the controlling unit include equipment of sequencers, and computers.

Hereinafter, an image forming apparatus and a process cartridge according to the present invention will be explained in detail with reference to the drawings.

The image forming apparatus of the present invention undergoes at least the processes of charging a photoconductor, exposing a latent electrostatic image, developing the image to obtain a toner image, transferring the toner image onto an image support material (transfer paper), fixing the toner image, and cleaning a surface of the photoconductor.

Note that in some instances, an image forming apparatus that directly transfers a latent electrostatic image onto a recording medium and develops the transferred image does not necessarily undergoes the above-mentioned processes.

Figure 7:
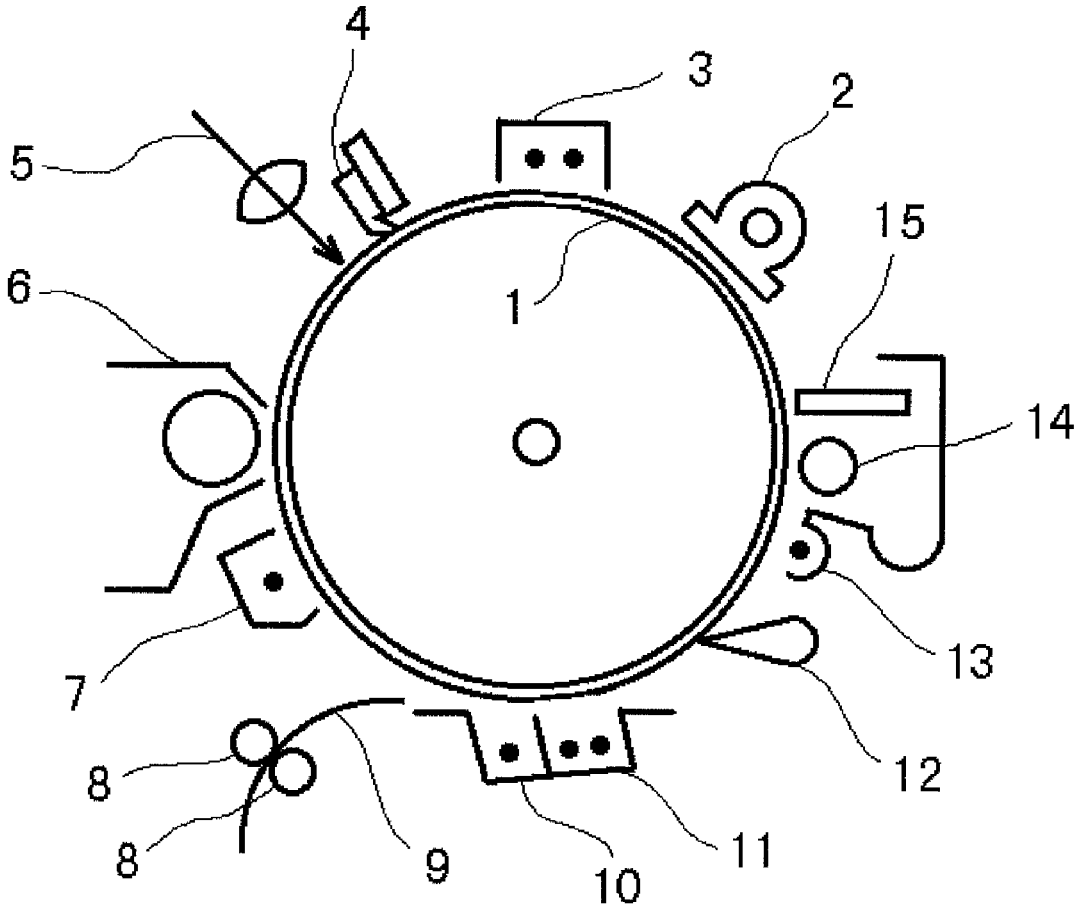
FIG. 7 is a schematic view showing one example of an image forming apparatus of the present invention.

FIG. 7 is a schematic view exemplarily showing an image forming apparatus. As a unit of uniformly charging a surface of a photoconductor, a charging unit 3 is used. As the charging unit 3, a corotron device, scorotron device, solid discharge element, needle-electrode device, roller-charging device, and conductive brush device are used based on a conventional charging method.

Next, in order to form a latent electrostatic image on a uniformly charged photoconductor 1, an image exposing unit 5 is used. For a light source of the image exposing unit 5, all around luminescent light sources such as a fluorescent lamp, tungsten lamp, halogen lamp, mercury lamp, sodium lamp, light-emitting diode (LED), semiconductor laser (LD), and electro luminescence (EL) can be used. Also, in order to irradiate only a light having a desired wavelength range, various filters such as a sharp-cut filter, band pass filter, infrared ray cut filter, dichroic filter, coherent light, and color conversion filter can be used.

Next, in order to visualize the latent electrostatic image formed on the photoconductor 1, a developing unit 6 is used. As the developing method, there are one component developing method using a dry-process toner, two-component developing method using a dry-process toner, and wet-process developing method using a wet-process toner. When a positive (negative) charge is applied to a photoconductor so as to expose an image formed on the photoconductor, a positive (negative) electrostatic latent image is formed on the photoconductor surface. When the positive (negative) electrostatic latent image is developed using a reversed polarity toner, a positive image can be obtained. When the positive (negative) electrostatic latent image is developed using a toner having the same polarity, a negative image can be obtained.

Next, to transfer a toner image visualized on the photoconductor onto a recording medium 9, a transfer charger 10 is used. Further, a pre-transfer charger may also be used to efficiently carry out a transfer process. As a transfer method, a mechanical transfer method using a transfer charger and a bias roller, such as an electrostatic transfer method, adhesion transfer method, and pressure transfer method, or a magnetic transfer method can be employed. For the electrostatic transfer method, the above-mentioned charging unit can be utilized.

Next, as a unit of separating the recording medium 9 from the photoconductor 1, a separation charger 11 and a separation pawl 12 are used. As additional separation methods, electrostatic adhesion induction separation, side edge belt separation, tip grip conveyance, and curvature separation and the like may be used. As the separation charger 11, the above-mentioned charging unit is utilized.

Next, in order to remove untransferred toner remaining on the photoconductor, a fur brush 14 and a cleaning blade 15 are used. To more efficiently remove the untransferred toner, a pre-cleaning charger 13 may also be employed. As other cleaning methods, there are web cleaning methods, magnet brush methods etc. These methods may be used along or in combination.

Further, with a view toward removing a latent electrostatic image remaining on the photoconductor, a charge eliminating unit is used. As the charge eliminating unit, a charge eliminating lamp 2, and a charge eliminating charger are used. The light source of the exposing unit and the charging unit can be used therefor.

Besides the above described, for processes of document reading, paper feeding, fixing, paper ejection and the like, conventionally known units can be used.

The present invention provides an image forming method and an image forming apparatus using an electrophotographic photoconductor of the present invention as the above-mentioned image forming method and units.

Figure 8:
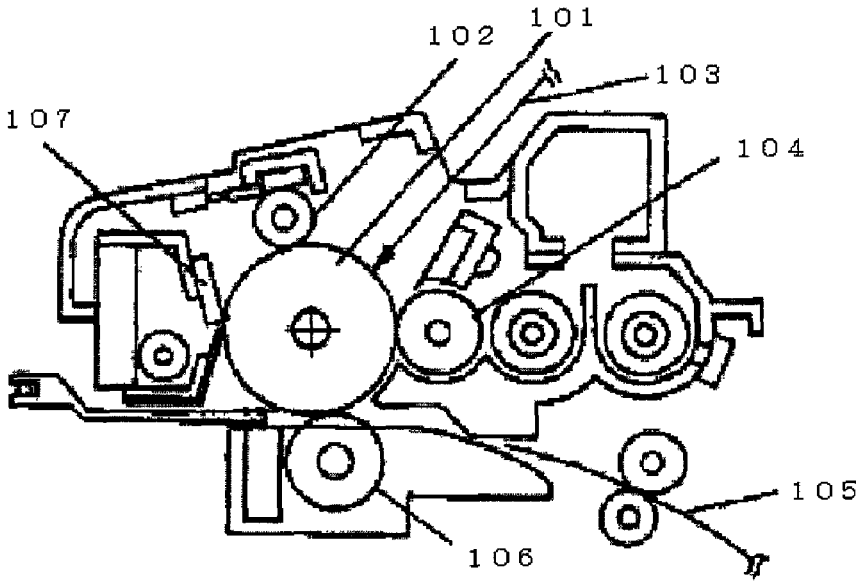
FIG. 8 is a schematic view showing one example of a process cartridge of the present invention.

The image forming unit may be incorporated in a copier, a facsimile or a printer in a fixed manner, and may be incorporated in such an image forming apparatus in the form of process cartridge or may be detachably mounted on the apparatus. FIG. 8 illustrates one example of the process cartridge.

The process cartridge incorporates a photoconductor 101 and additionally has at least one selected from a charging unit 102, a developing unit 104, a transfer unit 106, a cleaning unit 107, and a charge eliminating unit (not shown), and is a component which is detachably mounted to a main body of an image forming apparatus.

In an image formation process by means of a process cartridge shown in FIG. 8, the photoconductor 101, while rotating in a direction indicated by an arrow, undergoes charging by a charging unit 102 and exposure of light by means of an exposing unit 103 to form a latent electrostatic image corresponding to the exposed image on its surface. The latent electrostatic image is developed with a toner by the developing unit 104 to forma a toner image. The toner image is transferred onto a recording medium 105 by the transfer unit 106 and then printed out. Subsequently, the surface of the photoconductor after the transfer of image is cleaned by the cleaning unit 107, and further a residual charge remaining on the photoconductor surface is eliminated by a charge eliminating unit (not shown). Subsequently, the above-mentioned operation is repeated.

In the image forming method, the image forming apparatus, and the process cartridge of the present invention, an electrophotographic photoconductor according to the present invention, which has an intermediate layer composed of an amorphous oxide semiconductor is used. Therefore, they have least degradation in electrophotographic properties such as a reduction in chargeability, and make it possible to continuously obtain a high-quality image having less image defects.

EXAMPLES

Hereinafter, the present invention will be further described in detail referring to specific Examples and Comparative Examples, however, the present invention is not limited to the disclosed Examples. On the contrary, the present invention is intended to cover various modifications and equivalent arrangements included within the spirit and scope of the appended claims.

Example 1

<Production of Electrophotographic Photoconductor>

As a support, an aluminum cylinder of 0.9 μm in surface roughness, 30 mm in diameter, and 360 mm in length was prepared. The surface roughness (Rz) was measured over an evaluation length of 2.5 mm at a reference length of 0.5 mm using SURFCOM 1400D (manufactured by TOKYO SEIMITSU CO., LTD.). As measurement sites, three points of two sites of 80 mm away from both ends of the drum in its axial direction and a center site of the drum were measured in fourfold at an angle of 90° in a circumferential direction, and thus 12 points in total were measured.

Using an RF sputtering apparatus which had been remodeled so as to carry out film formation, while rotating an aluminum cylinder serving as a support, an intermediate layer was formed on the surface of the cylinder. Inside the cylinder, a cooling jacket was provided so as to prevent the support temperature from excessively increasing during sputtering process. More specifically, an amorphous oxide film composed of indium, zinc and gallium (otherwise referred to herein as "In—Ga—$ZnO_x$") was formed as the intermediate layer using a target of 150 mm×400 mm in size and formed of a sintered polycrystal containing indium, zinc and gallium [composition ratio (In:Zn:Ga)=1:1:1]. The following explains the film formation conditions.

cooling temperature of support: 30° C.
sputtering output power: 11.2 W/cm$^2$
distance between target and support surface: 50 mm
back pressure: $5.0\times10^{-6}$ torr or lower
film formation pressure: $3.0\times10^{-3}$ torr
inert gas: argon
oxygen partial pressure: 3% by volume relative to the total amount of inert gas and oxygen gas Under the above film formation conditions, an In—Ga—$ZnO_x$ intermediate layer of 0.5 μm in thickness was formed as the intermediate layer. The thickness of the thus obtained intermediate layer was measured using a reflection-type spectroscopic film thickness meter (FE-3000 manufactured by Otsuka Electronics Co., Ltd.).

<Surface Resistivity of Amorphous Oxide Semiconductor>

As an evaluation of electrical resistance of the amorphous oxide semiconductor having a thickness of 0.5 μm produced in Example 1, its surface resistivity was measured according to the method described below.

As a substrate forming the amorphous oxide semiconductor, an alkali-free glass (CORNING #1737) was used instead of a support, and an amorphous oxide semiconductor was formed under the same other conditions described in Example 1. The surface resistivity thereof was measured as follows. In the measurement of surface resistivity, Au electrodes of 10 mm in length were formed by deposition with a gap therebetween of 25 μm on the alkali-free glass that had been formed as an amorphous oxide semiconductor, and a current passing through the amorphous oxide semiconductor at the time of applying a bias between the electrodes, the measurement of surface resistivity was carried out 10 times while changing measurement sites, the average value was determined, and the amorphous oxide semiconductor having a thickness of 0.5 μm was found to have a surface resistivity of $5.0\times10^6$ Ω/cm$^2$.

Next, a charge generating layer coating liquid and a charge transporting layer coating liquid each having the following composition were applied in this order over the amorphous oxide semiconductor, and dried to thereby form a charge generating layer having a thickness of 0.3 μm and a charge transporting layer having a thickness of 20 μm

| | |
|---|---|
| [Charge generating layer coating liquid] | |
| τ-type metal-free phthalocyanine (average particle diameter: 0.34 μm, FASTOGEN Blue 8120B, produced by Dai-Nippon Ink Chemical Industries Co., Ltd) | 8 parts by mass |
| polyvinyl butyral (XYHL, produced by UCC Corp.). | 5 parts by mass |
| methylethylketone | 80 parts by mass |
| [Charge transporting layer coating liquid] | |
| bisphenol Z polycarbonate (PANLITE TS-2050, produced by Teijin Chemicals Ltd.) | 10 parts by mass |
| low-molecular weight charge transporting material represented by the following Structural Formula (1) | 7 parts by mass |

Structural Formula (1)

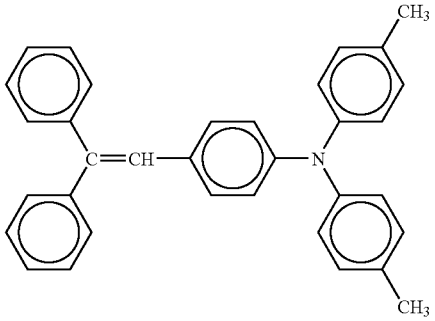

| | |
|---|---|
| tetrahydrofuran | 100 parts by mass |
| 1% by mass tetrahydrofuran solution of silicone oil (KF50-100CS, produced by Shin-Etsu Chemical Co., Ltd.) | 1 part by mass |

<Analysis of Structure of Amorphous Oxide Semiconductor>

The fact that the oxide semiconductor produced in Example 1, which was composed of indium, zinc and gallium, was amorphous was confirmed by X-ray diffraction to thereby evaluate the crystal structure thereof.

[Evaluation of Oxide Semiconductor by X-Ray Diffraction]

analyzer: X-ray diffractometer: X' PART PRO (manufactured by Philips Electronics Instruments, Inc.)

X-ray emission source: Cu (filling tube)

filter: not used scanning axis: 2θ/θ measurement angle range: 10° to 100°

Figure 9:
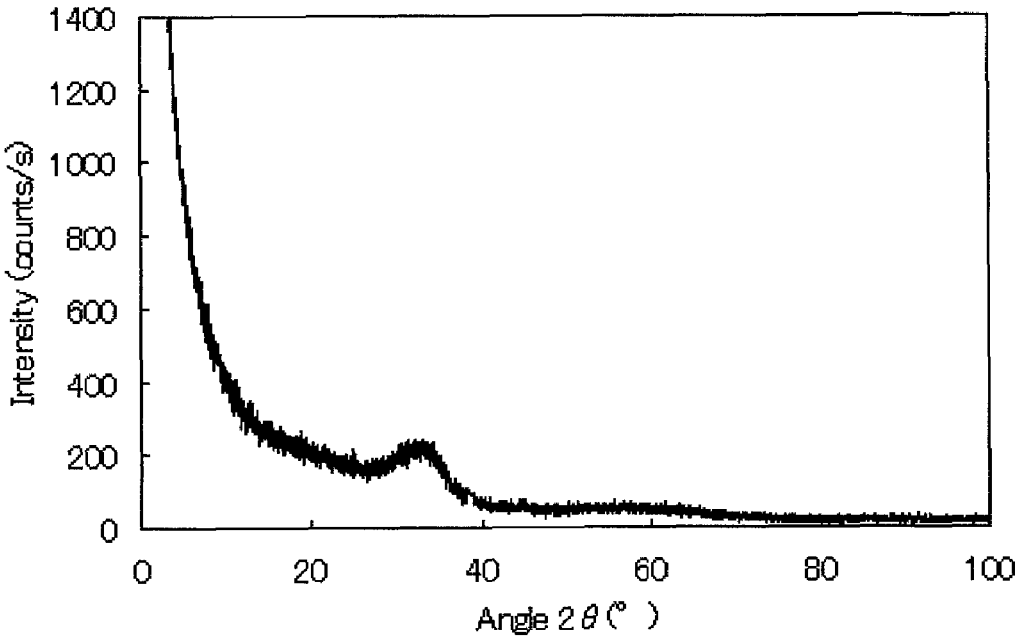
FIG. 9 is a view showing the result of crystal structure analysis by X-ray diffraction of the amorphous oxide semiconductor composed of indium, zinc, and gallium, which was prepared in Example 1.

FIG. 9 shows the measurement results. The results showed that the formed intermediate layer was an amorphous oxide semiconductor.

<Composition of Amorphous Oxide Semiconductor>

The structural components and composition ratio of the amorphous oxide semiconductor produced in Example 1 were analyzed by the following fluorescent X-ray analysis. The composition profile of the amorphous oxide semiconductor in a depth direction was analyzed by the following Auger electron spectroscopy.

[Evaluation of Amorphous Oxide Semiconductor by Fluorescent X-Ray Analysis]

analyzer: wavelength dispersive fluorescent X-ray analyzer (RIX3000, manufactured by Rigaku Industrial Corp.)

X-ray tube bulb: Rh output power: 50 kV current: 50 mA

The analysis results under the conditions described above showed that the amorphous oxide semiconductor obtained in Example 1 was an oxide composed of indium, zinc, and gallium, and was an amorphous oxide semiconductor having a composition ratio of In:Zn:Ga=100:112:117.

Figure 10:
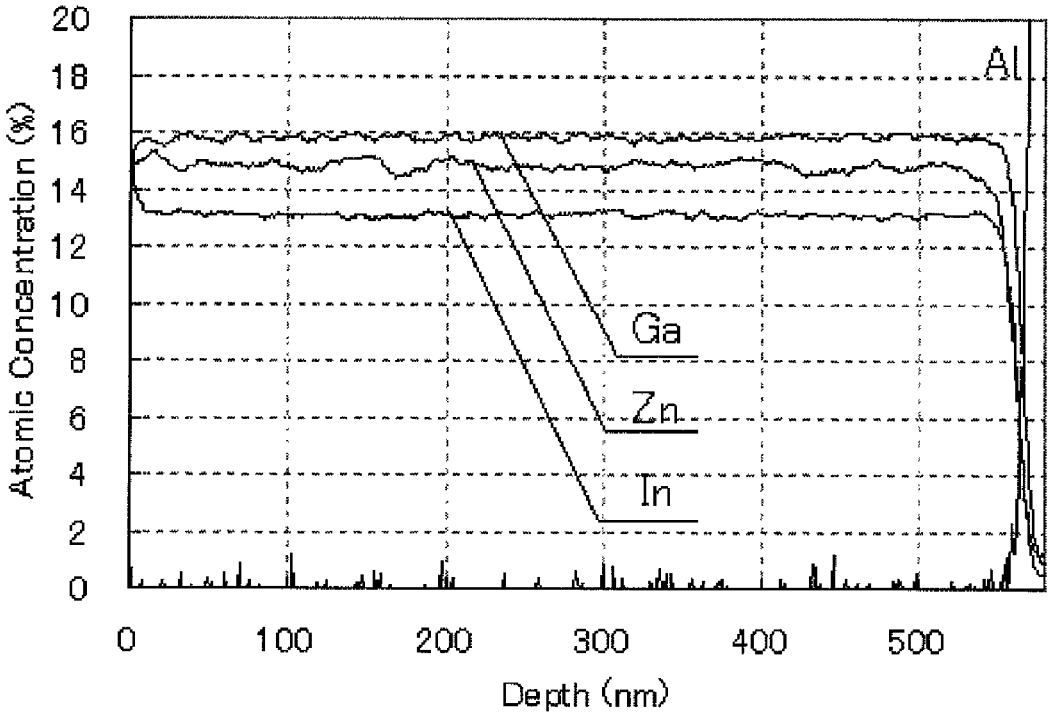
FIG. 10 is a view showing the evaluation result of the amorphous oxide semiconductor composed of indium, zinc, and gallium, which was prepared in Example 1, by using Auger electron spectroscopy.

[Evaluation of Amorphous Oxide Semiconductor by Auger Electron Spectroscopy]

measurement device: FE-SAM680 (manufactured by Physical Electronics Inc.)

accelerating voltage: 10 kV amount of current: 10 nA sputtering-etching conditions: Ar ion/accelerating voltage 1 kV FIG. 10 shows the analysis results. The results showed that the amorphous oxide semiconductor had less variation in these constituent elements (indium, zinc, and gallium) in a depth direction thereof and was an extremely uniform amorphous oxide semiconductor.

Synthesis Example 1

—Synthesis of titanyl phthalocyanine and Preparation of X-Ray Diffraction Test Sample—

In a vessel, 292 parts by mass of 1,3-diiminoisoindline and 1,800 parts by mass of sulfolane were mixed, and 204 parts by mass of titanium tetrabuthoxide was delivered by drops into the vessel under nitrogen gas stream. Upon completion of the dropping, the temperature of the mixture was gradually raised to 180° C., and the mixture was stirred for reaction for 5 hours while maintaining the reaction temperature ranging from 170° C. to 180° C. After the completion of reaction, the reaction product was left to cool. The resultant precipitate was filtered to obtain a powder. The powder was washed until it became blue, washed with methanol several times, and further washed with hot water of 80° C. several times, and then dried to thereby obtain a coarse titanyl phthalocyanine. Then, the obtained coarse titanyl phthalocyanine was washed with hot water, and 60 parts by mass thereof was added to 1,000 parts by mass of 96% sulfric acid, stirred therewith at a temperature of 3° C. to 5° C. so as to be dissolved, and the solution was filtered. The thus obtained sulfuric acid solution was delivered by drops into 35,000 parts by mass of iced water with stirring to separate out a crystal. The crystal was filtered and then repeatedly washed with water until the wash fluid was neutralized to thereby obtain a water paste of titanyl phthalocyanine pigment. To this water paste, 1,500 parts by mass of tetrahydrofuran was added and stirred at room temperature, and the stirring was stopped when the color of water paste of navy blue turned light blue, and immediately thereafter followed by a filtration under reduced pressure to thereby obtain a crystal on the filter. The crystal was then washed with tetrahydrofuran to obtain 98 parts by mass of a pigment wet cake. The pigment wet cake was dried under reduced pressure (5 mmHg) at 70° C. for two days, thereby obtaining 78 parts by mass of titanyl phthalocyanine.

<X-Ray Diffraction>

The titanyl phthalocyanine as above was measured by a powder method using CuKα (wavelength: 1.542 Å) under the following conditions.

X-ray diffractometer: X'PERT manufactured by Philips Electronics Instruments, Inc.

Measurement Conditions:

X-ray tube bulb: Cu

Voltage applied to tube: 50 kV

Current flowing into tube: 30 mA

Scanning speed: 2°/min

Scanning range: 3° to 40°

Time constant: 2 sec

Step angle: 0.01°

Counting time: 20 sec

Light entrance slit—light exit slit: variable type

Irradiation width: 20 mm

Figure 11:
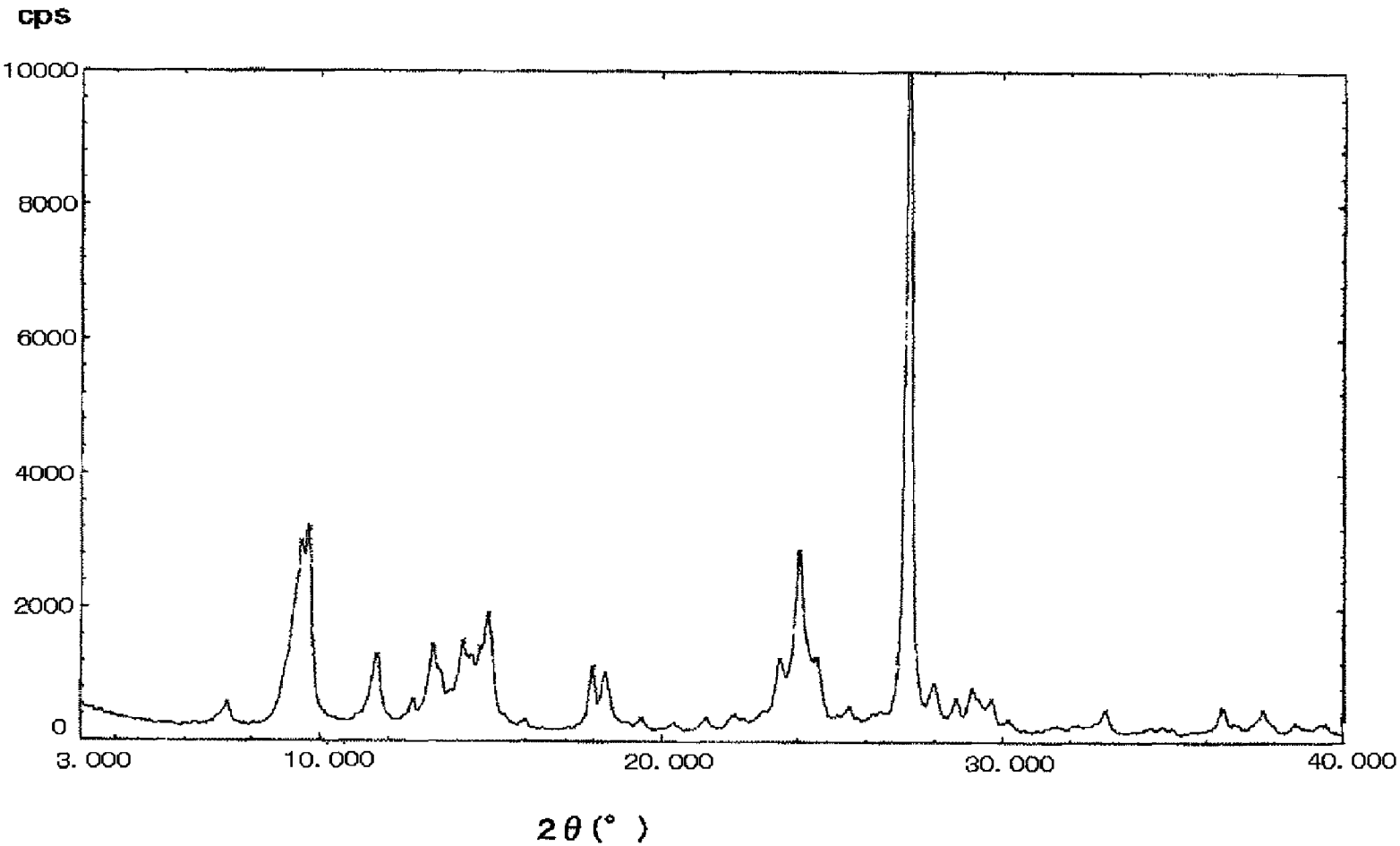
FIG. 11 is an X-ray diffraction spectrum of titanylphthalocyanine used in Example 2.

FIG. 11 shows an X-ray diffraction pattern of the titanyl phthalocyanine crystal. It is clear from FIG. 11 that the titanyl phthalocyanine crystal has a highest peak at a Bragg angle (2θ±0.2°) of 27.2° and a lowest angle peak at 7.3°. It was also found that the crystal is a titanyl phthalocyanine crystal having major peaks at a Bragg angle (2θ±0.2°) of 9.4°, 9.6° and 24.0°, having no peaks within the range of from 7.4° to less than 9.4° and also having no peak at 26.3°.

Example 2

—Production of Electrophotographic Photoconductor—

An electrophotographic photoconductor of Example 2 was produced in a similar manner to that used in Example 1 except that the charge generating layer coating liquid used in Example 1 was changed to the following charge generating layer coating liquid.

| [Charge generating layer coating liquid] | |
|---|---|
| titanyl phthalocyanine shown in FIG. 11 (average particle diameter: 0.31 μm) | 8 parts by mass |
| polyvinyl butyral (XYHL, manufactured by UCC) | 5 parts by mass |
| methylethylketone | 80 parts by mass |

Example 3

—Production of Electrophotographic Photoconductor—

An electrophotographic photoconductor of Example 3 was produced in a similar manner to that used in Example 1 except that the charge transporting layer coating liquid used in Example 1 was changed to the following charge transporting layer coating liquid.

| [Charge transporting layer coating liquid] | |
|---|---|
| polymeric charge transporting material represented by the following Structural Formula (2) (weight average molecular weight (Mw) = 130,000) | 10 parts by mass |
| tetrahydrofuran | 100 parts by mass |
| 1% by mass tetrahydrofuran solution of silicone oil (KF50-100CS, produced by Shin-Etsu Chemical Co., Ltd.) | 1 part by mass |

Structural Formula (2)

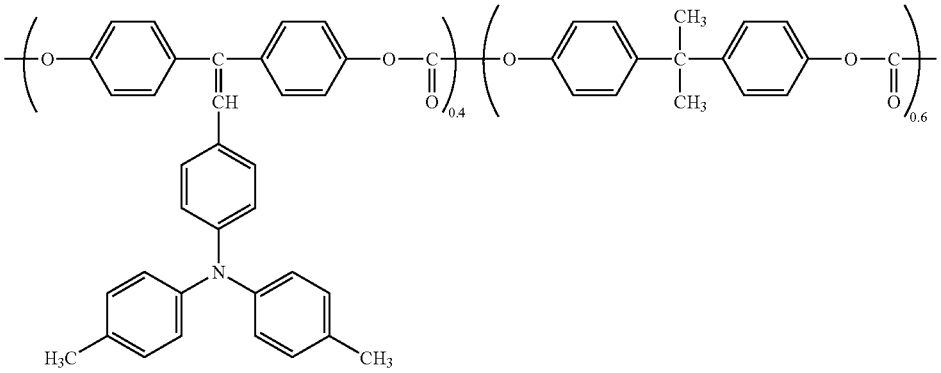

Example 4

—Production of Electrophotographic Photoconductor—

An electrophotographic photoconductor of Example 4 was produced in a similar manner to that used in Example 2 except that the charge transporting layer coating liquid used in Example 2 was changed to the following charge transporting layer coating liquid.

| [Charge transporting layer coating liquid] | |
|---|---|
| polymeric charge transporting material represented by the above Structural Formula (2) (weight average molecular weight (Mw) = 130,000) | 10 parts by mass |
| tetrahydrofuran | 100 parts by mass |
| 1% by mass tetrahydrofuran solution of silicone oil (KF50-100CS, produced by Shin-Etsu Chemical Co., Ltd.) | 1 part by mass |

Example 5

—Production of Electrophotographic Photoconductor—

An electrophotographic photoconductor of Example 5 was produced in a similar manner to that used in Example 1 except that the surface roughness (Rz) of the support was changed to 0.2 μm.

Example 6

—Production of Electrophotographic Photoconductor—

An electrophotographic photoconductor of Example 6 was produced in a similar manner to that used in Example 2 except that the surface roughness (Rz) of the support used in Example 2 was changed to 0.2 μm.

Example 7

—Production of Electrophotographic Photoconductor—

An electrophotographic photoconductor of Example 7 was produced in a similar manner to that used in Example 2 except that the thickness of the intermediate layer formed in Example 2 was changed to 0.05 μm (an intermediate layer was formed under a similar film formation condition to that used in Example 2 except that only the film formation time was reduced to one-tenth the time length employed in Example 2).

Example 8

—Production of Electrophotographic Photoconductor—

An electrophotographic photoconductor of Example 8 was produced in a similar manner to that used in Example 2 except that the thickness of the intermediate layer formed in Example 2 was changed to 0.15 μm (an intermediate layer was formed under a similar film formation condition to that used in Example 2 except that only the film formation time was reduced to three-tenth the time length employed in Example 2).

Example 9

—Production of Electrophotographic Photoconductor—

An electrophotographic photoconductor of Example 9 was produced in a similar manner to that used in Example 2 except that the thickness of the intermediate layer formed in Example 2 was changed to 0.8 μm (an intermediate layer was formed under a similar film formation condition to that used in Example 2 except that only the film formation time was increased to 1.6 times the time length employed in Example 2).

Example 10

—Production of Electrophotographic Photoconductor—

An electrophotographic photoconductor of Example 10 was produced in a similar manner to that used in Example 2 except that the thickness of the intermediate layer formed in Example 2 was changed to 1.0 μm (an intermediate layer was formed under a similar film formation condition to that used in Example 2 except that only the film formation time was increased to 2 times the time length employed in Example 2).

Example 11

—Production of Electrophotographic Photoconductor—

An electrophotographic photoconductor of Example 11 was produced in a similar manner to that used in Example 10 except that the charge transporting layer coating liquid used in Example 10 was changed to the following charge transporting layer coating liquid.

| [Charge transporting layer coating liquid] | |
|---|---|
| polymeric charge transporting material represented by the above Structural Formula (2) (weight average molecular weight (Mw) = 130,000) | 10 parts by mass |
| tetrahydrofuran | 100 parts by mass |
| 1% by mass tetrahydrofuran solution of silicone oil (KF50-100CS, produced by Shin-Etsu Chemical Co., Ltd.) | 1 part by mass |

Example 12

—Production of Electrophotographic Photoconductor—

An electrophotographic photoconductor of Example 12 was produced in a similar manner to that used in Example 11 except that the charge transporting layer coating liquid used in Example 11 was changed to the following charge transporting layer coating liquid.

| [Charge transporting layer coating liquid] | |
|---|---|
| polymeric charge transporting material represented by the above Structural Formula (2) (weight average molecular weight (Mw) = 130,000) | 10 parts by mass |
| tetrahydrofuran | 100 parts by mass |
| 1% by mass tetrahydrofuran solution of silicone oil (KF50-100CS, produced by Shin-Etsu Chemical Co., Ltd.) | 1 part by mass |

Example 13

—Production of Electrophotographic Photoconductor—

An electrophotographic photoconductor of Example 13 was produced in a similar manner to that used in Example 12 except that the charge transporting layer coating liquid used in Example 12 was changed to the following charge transporting layer coating liquid.

| [Charge transporting layer coating liquid] | |
|---|---|
| polymeric charge transporting material represented by the above Structural Formula (2) (weight average molecular weight (Mw) = 130,000) | 10 parts by mass |
| tetrahydrofuran | 100 parts by mass |
| 1% by mass tetrahydrofuran solution of silicone oil (KF50-100CS, produced by Shin-Etsu Chemical Co., Ltd.) | 1 part by mass |

Example 14

—Production of Electrophotographic Photoconductor—

An electrophotographic photoconductor of Example 14 was produced in a similar manner to that used in Example 13 except that the charge transporting layer coating liquid used in Example 13 was changed to the following charge transporting layer coating liquid.

| [Charge transporting layer coating liquid] | |
|---|---|
| polymeric charge transporting material represented by the above Structural Formula (2) (weight average molecular weight (Mw) = 130,000) | 10 parts by mass |
| tetrahydrofuran | 100 parts by mass |
| 1% by mass tetrahydrofuran solution of silicone oil (KF50-100CS, produced by Shin-Etsu Chemical Co., Ltd.) | 1 part by mass |

Example 15

—Production of Electrophotographic Photoconductor—

An electrophotographic photoconductor of Example 15 was produced in a similar manner to that used in Example 2 except that in the film formation method of the intermediate layer of Example 2 the sintered polycrystal containing indium, zinc and gallium was changed to a sintered polycrystal having a composition ratio of indium, zinc and gallium (In:Zn:Ga) of 1:1.5:1.

For the obtained electrophotographic photoconductor of Example 15, the composition ratio of the amorphous oxide semiconductor was measured using the evaluation method described in Example 1. As a result, the amorphous oxide semiconductor was found to have a composition ratio (In:Zn:Ga) of 100:108:137.

The amorphous oxide semiconductor was found to have a surface resistivity of $4.9\times10^7$ Ω/cm$^2$, which was measured by the same evaluation method as in Example 1.

Example 16

—Production of Electrophotographic Photoconductor—

An electrophotographic photoconductor of Example 16 was produced in a similar manner to that used in Example 2 except that in the film formation method of the intermediate layer of Example 2, the sintered polycrystal containing indium, zinc and gallium was changed to a sintered polycrystal having a composition ratio of indium, zinc and gallium (In:Zn:Ga) of 1:0.75:1.

For the obtained electrophotographic photoconductor of Example 16, the composition ratio of the amorphous oxide semiconductor was measured using the evaluation method described in Example 1. As a result, the amorphous oxide semiconductor was found to have a composition ratio (In:Zn:Ga) of 100:110:105.

The amorphous oxide semiconductor was found to have a surface resistivity of $6.2\times10^5$ Ω/cm$^2$, which was measured by the same evaluation method as in Example 1.

Example 17

—Production of Electrophotographic Photoconductor—

An electrophotographic photoconductor of Example 17 was produced in a similar manner to that used in Example 2 except that in the film formation method of the intermediate layer of Example 2, the sintered polycrystal containing indium, zinc and gallium was changed to a sintered polycrystal having a composition ratio of indium and gallium (In:Ga) of 1:1.

For the obtained electrophotographic photoconductor of Example 17, the composition ratio of the amorphous oxide semiconductor was measured using the evaluation method described in Example 1. As a result, the amorphous oxide semiconductor was found to have a composition ratio (In:Ga) of 100:125.

The amorphous oxide semiconductor was found to have a surface resistivity of $6.7\times10^7$ Ω/cm$^2$, which was measured by the same evaluation method as in Example 1.

Example 18

—Production of Electrophotographic Photoconductor—

An electrophotographic photoconductor of Example 18 was produced in a similar manner to that used in Example 2 except that in the film formation method of the intermediate layer of Example 2, the sintered polycrystal containing indium, zinc and gallium was changed to a sintered polycrystal having a composition ratio of indium and zinc (In:Zn) of 1:1.

For the obtained electrophotographic photoconductor of Example 18, the composition ratio of the amorphous oxide semiconductor was measured using the evaluation method described in Example 1. As a result, the amorphous oxide semiconductor was found to have a composition ratio (In:Zn) of 100:111.

The amorphous oxide semiconductor was found to have a surface resistivity of $7.5\times10^6$ Ω/cm$^2$, which was measured by the same evaluation method as in Example 1.

Example 19

—Production of Electrophotographic Photoconductor—

An electrophotographic photoconductor of Example 19 was produced in a similar manner to that used in Example 1 except that over the intermediate layer formed in Example 1, a charge generating layer coating liquid and a charge transporting layer coating liquid each having the following composition were applied in this order and dried to thereby form a charge generating layer having a thickness of 0.2 μm and a charge transporting layer having a thickness of 20 μm.

| [Charge generating layer coating solution] | |
|---|---|
| bisazo pigment represented by the following Structural Formula (3) | 2.5 parts by mass |

-continued

Structural Formula (3)

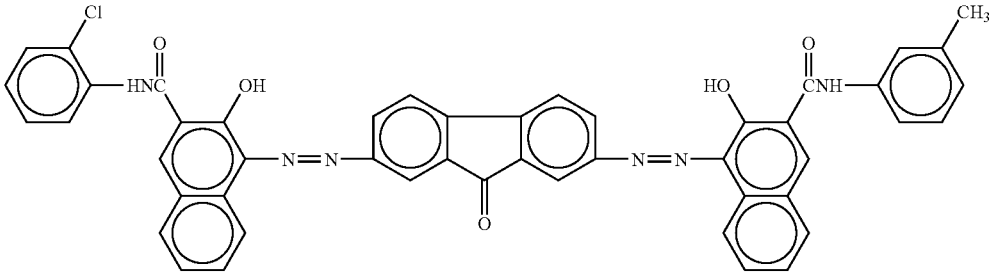

| | |
|---|---|
| polyvinyl butyral (XYHL, produced by UCC) | 0.5 parts by mass |
| cyclohexanone | 200 parts by mass |
| methylethylketone | 80 parts by mass |
| [Charge transporting layer coating liquid] | |
| bisphenol Z polycarbonate (PANLITE TS-2050, produced by Teijin Chemicals Ltd.) | 10 parts by mass |
| low-molecular weight charge transporting material represented by the above Structural Formula (1) | 7 parts by mass |
| tetrahydrofuran | 100 parts by mass |
| 1% by mass tetrahydrofuran solution of silicone oil (KF50-100CS, produced by Shin-Etsu Chemical Co., Ltd.) | 1 part by mass |

Next, a surface layer coating liquid having the following composition was applied over a laminate formed of the support, intermediate layer, charge generating layer and charge transporting layer, using a spray coating method, and the applied surface layer was irradiated with light using a metal halide lamp under the conditions of illuminance intensity: 900 mW/cm$^2$ and irradiation time: 20 seconds so as to be crosslinked, thereby obtaining a surface cured layer of 5.0 μm in thickness. Subsequently, the surface cured layer was dried at 130° C. for 30 minutes, thereby producing an electrophotographic photoconductor composed of a support, an intermediate layer, a charge generating layer, a charge transporting layer and a surface layer.

| | |
|---|---|
| [Surface layer coating liquid] | |
| radically polymerizable monomer having no charge transporting structure, which is represented by the following Structural Formula (4) (trimethylolpropane triacrylate, TMPTA, produced by Tokyo Chemical Industry Co., Ltd.) | 95 parts by mass |

Structural Formula (4)

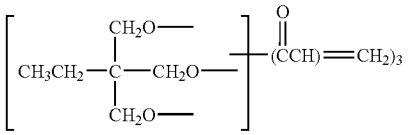

| | |
|---|---|
| radically polymerizable compound having a charge transporting structure represented by the following Structural Formula (5) | 95 parts by mass |

-continued

Structural Formula (5)

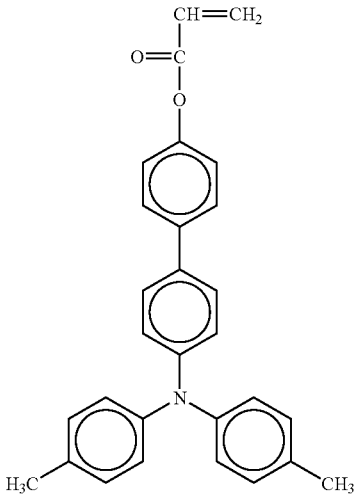

| | |
|---|---|
| photopolymerization initiator (1-hydroxy-cyclohexyl-phenyl-ketone, IRGACURE I-184, produced by Chiba Specialty Chemicals K.K. | 10 parts by mass |
| tetrahydrofuran | 1,200 parts by mass |

Example 20

—Production of Electrophotographic Photoconductor—

An electrophotographic photoconductor of Example 20 was produced in a similar manner to that used in Example 19 except that the radically polymerizable monomer having no charge transporting structure used for the surface layer coating liquid of Example 19 was changed to a radically polymerizable monomer described below.

| | |
|---|---|
| radically polymerizable monomer having no charge transporting structure, which is represented by the following Structural Formula (6), caprolactone-modified dipentaerythritol hexaacrylate (KAYARD DPCA-120, produced by Nippon Kayaku Co., Ltd.) | 95 parts by mass |

Structural Formula (6)

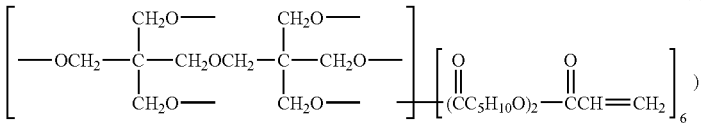

Example 21

—Production of Electrophotographic Photoconductor—

An electrophotographic photoconductor of Example 21 was produced in a similar manner to that used in Example 19 except that the radically polymerizable monomer having no charge transporting structure used for the surface layer coating liquid of Example 19 was changed to a radically polymerizable monomer described below.

| | |
|---|---|
| radically polymerizable monomer having no charge transporting structure, which is represented by the following Structural Formula (7), (dipentaerythritol hexaacrylate, KAYARD DPHA, produced by Nippon Kayaku Co., Ltd.) | 95 parts by mass |

Structural Formula (7)

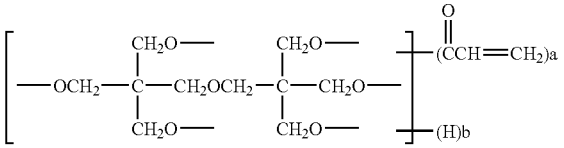

Note that the radically polymerizable monomer is a mixture in which a compound with "a" is equal to 5 and "b" is equal to 1, and a compound with "a" is equal to 6 and "b" is equal to 0 are mixed at a mass ratio of 1:1.

Example 22

—Production of Electrophotographic Photoconductor—

An electrophotographic photoconductor of Example 22 was produced in a similar manner to that used in Example 19 except that the radically polymerizable monomer having no charge transporting structure used for the surface layer coating liquid of Example 19 was changed to a radically polymerizable monomer described below.

| | |
|---|---|
| radically polymerizable monomer having no charge transporting structure | 95 parts by mass |

the monomer is a mixed monomer in which the following compounds (1) and (2) are mixed at a mass ratio of 1:1.
(1) trimethylolpropane triacrylate (represented by the above Structural Formula (4), TMPTA, produced by Tokyo Chemical Industry Co., Ltd.)
(2) caprolactone-modified dipentaerythritol hexaacrylate (represented by the above Structural Formula (6), KAYARAD DPCA-120, produced by Nippon Kayaku Co., Ltd.)

Example 23

—Production of Electrophotographic Photoconductor—

An electrophotographic photoconductor of Example 23 was produced in a similar manner to that used in Example 22 except that the radically polymerizable monomer having a charge transporting structure used for the surface layer coating liquid of Example 22 was changed to a compound represented by the following Structural Formula (8).

Structural Formula (8)

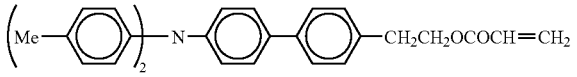

In Structural Formula (8), Me represents a methyl group.

Example 24

—Production of Electrophotographic Photoconductor—

An electrophotographic photoconductor of Example 24 was produced in a similar manner to that used in Example 22 except that a charge transporting material having no radical polymerizable function group, which is represented by the above Structural Formula (1), was used instead of the radically polymerizable monomer having a charge transporting structure used for the surface layer coating liquid of Example 22.

Example 25

—Production of Electrophotographic Photoconductor—

An electrophotographic photoconductor of Example 25 was produced in a similar manner to that used in Example 22 except that the thickness of the intermediate layer formed in Example 22 was changed to 0.05 μm (an intermediate layer was formed under a similar film formation condition to that used in Example 1 except that only the film formation time was reduced to one-tenth the time length employed in Example 1).

Example 26

—Production of Electrophotographic Photoconductor—

An electrophotographic photoconductor of Example 26 was produced in a similar manner to that used in Example 22 except that the thickness of the intermediate layer formed in Example 22 was changed to 0.15 μm (an intermediate layer was formed under a similar film formation condition to that used in Example 1 except that only the film formation time was reduced to three-tenth the time length employed in Example 1).

Example 27

—Production of Electrophotographic Photoconductor—

An electrophotographic photoconductor of Example 27 was produced in a similar manner to that used in Example 22 except that the thickness of the intermediate layer formed in Example 22 was changed to 0.8 μm (an intermediate layer was formed under a similar film formation condition to that used in Example 1 except that only the film formation time was increased to 1.6 times the time length employed in Example 1).

Example 28

—Production of Electrophotographic Photoconductor—

An electrophotographic photoconductor of Example 28 was produced in a similar manner to that used in Example 22 except that the thickness of the intermediate layer formed in Example 22 was changed to 1.0 μm (an intermediate layer was formed under a similar film formation condition to that used in Example 1 except that only the film formation time was increased to 2 times the time length employed in Example 1).

Example 29

—Production of Electrophotographic Photoconductor—

An electrophotographic photoconductor of Example 29 was produced in a similar manner to that used in Example 25 except that the radically polymerizable monomer having a charge transporting structure used for the surface layer coating liquid of Example 25 was changed to a radically polymerizable monomer represented by the above Structural Formula (8)

Example 30

—Production of Electrophotographic Photoconductor—

An electrophotographic photoconductor of Example 30 was produced in a similar manner to that used in Example 26 except that the radically polymerizable monomer having a charge transporting structure used for the surface layer coating liquid of Example 26 was changed to a radically polymerizable monomer represented by the above Structural Formula (8)

Example 31

—Production of Electrophotographic Photoconductor—

An electrophotographic photoconductor of Example 31 was produced in a similar manner to that used in Example 27 except that the radically polymerizable monomer having a charge transporting structure used for the surface layer coating liquid of Example 27 was changed to a radically polymerizable monomer represented by the above Structural Formula (8)

Example 32

—Production of Electrophotographic Photoconductor—

An electrophotographic photoconductor of Example 32 was produced in a similar manner to that used in Example 28 except that the radically polymerizable monomer having a charge transporting structure used for the surface layer coating liquid of Example 28 was changed to a radically polymerizable monomer represented by the above Structural Formula (8)

Example 33

—Production of Electrophotographic Photoconductor—

An electrophotographic photoconductor of Example 33 was produced in a similar manner to that used in Example 25 except that a charge transporting material having no radical polymerizable functional group, which is represented by the above Structural Formula (1), was used instead of the radically polymerizable monomer having a charge transporting structure used for the surface layer coating liquid of Example 25.

Example 34

—Production of Electrophotographic Photoconductor—

An electrophotographic photoconductor of Example 34 was produced in a similar manner to that used in Example 26 except that a charge transporting material having no radical polymerizable functional group, which is represented by the above Structural Formula (1), was used instead of the radically polymerizable monomer having a charge transporting structure used for the surface layer coating liquid of Example 26.

Example 35

—Production of Electrophotographic Photoconductor—

An electrophotographic photoconductor of Example 35 was produced in a similar manner to that used in Example 27 except that a charge transporting material having no radical polymerizable functional group, which is represented by the above Structural Formula (1), was used instead of the radically polymerizable monomer having a charge transporting structure used for the surface layer coating liquid of Example 27.

Example 36

—Production of Electrophotographic Photoconductor—

An electrophotographic photoconductor of Example 36 was produced in a similar manner to that used in Example 28 except that a charge transporting material having no radical polymerizable functional group, which is represented by the above Structural Formula (1), was used instead of the radically polymerizable monomer having a charge transporting structure used for the surface layer coating liquid of Example 28.

Example 37

—Production of Electrophotographic Photoconductor—

An electrophotographic photoconductor of Example 37 was produced in a similar manner to that used in Example 23 except that the surface roughness (Rz) of the support of Example 23 was changed to 0.2 μm.

Example 38

—Production of Electrophotographic Photoconductor—

An electrophotographic photoconductor of Example 38 was produced in a similar manner to that used in Example 24 except that the surface roughness (Rz) of the support of Example 24 was changed to 0.2 μm.

Example 39

—Production of Electrophotographic Photoconductor—

An electrophotographic photoconductor of Example 39 was produced in a similar manner to that used in Example 4 except that the radically polymerizable monomer having a charge transporting structure used for the surface layer coating liquid of Example 4 was changed to a compound represented by the following Structural Formula (9).

Structural Formula (9)

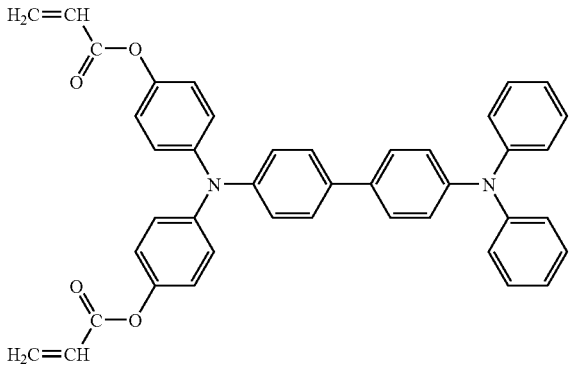

Example 40

An electrophotographic photoconductor of Example 40 was produced in a similar manner to that used in Example 22 except that in the film formation method of the intermediate layer of Example 22, a sintered polycrystal having a composition ratio of indium and gallium (In:Ga) of 1:1 was used.

For the obtained electrophotographic photoconductor of Example 40, the composition ratio of the amorphous oxide semiconductor was measured using the evaluation method described in Example 1. As a result, the amorphous oxide semiconductor was found to have a composition ratio (In:Ga) of 100:125.

The amorphous oxide semiconductor was found to have a surface resistivity of $6.7\times10^7$ Ω/cm$^2$, which was measured by the same evaluation method as in Example 1.

Example 41

An electrophotographic photoconductor of Example 41 was produced in a similar manner to that used in Example 22 except that in the film formation method of the intermediate layer of Example 22, a sintered polycrystal having a composition ratio of indium and zinc (In:Zn) of 1:1 was used.

For the obtained electrophotographic photoconductor of Example 41, the composition ratio of the amorphous oxide semiconductor was measured using the evaluation method described in Example 1. As a result, the amorphous oxide semiconductor was found to have a composition ratio (In:Zn) of 100:111.

The amorphous oxide semiconductor was found to have a surface resistivity of $7.5\times10^6$ Ω/cm$^2$, which was measured by the same evaluation method as in Example 1.

Example 42

An electrophotographic photoconductor of Example 42 was produced in a similar manner to that used in Example 22 except that in the film formation method of the intermediate layer of Example 22, a sintered polycrystal having a composition ratio of indium, zinc and gallium (In:Zn:Ga) of 1:1.5:1 was used.

For the obtained electrophotographic photoconductor of Example 42, the composition ratio of the amorphous oxide semiconductor was measured using the evaluation method described in Example 1. As a result, the amorphous oxide semiconductor was found to have a composition ratio (In:Zn:Ga) of 100:108:137.

The amorphous oxide semiconductor was found to have a surface resistivity of $4.9\times10^7$ Ω/cm$^2$, which was measured by the same evaluation method as in Example 1.

Example 43

An electrophotographic photoconductor of Example 43 was produced in a similar manner to that used in Example 22 except that in the film formation method of the intermediate layer of Example 22, a sintered polycrystal having a composition ratio of indium, zinc and gallium (In:Zn:Ga) of 1:0.75:1 was used.

For the obtained electrophotographic photoconductor of Example 43, the composition ratio of the amorphous oxide semiconductor was measured using the evaluation method described in Example 1. As a result, the amorphous oxide semiconductor was found to have a composition ratio (In:Zn:Ga) of 100:110:105.

The amorphous oxide semiconductor was found to have a surface resistivity of $6.2\times10^5$ Ω/cm$^2$, which was measured by the same evaluation method as in Example 1.

Comparative Example 1

—Production of Electrophotographic Photoconductor—

Over a support (aluminum cylinder having a surface roughness (Rz) of 0.9 μm, a diameter of 30 mm and a length of 360 mm) used in Example 1, the charge generating layer coating liquid and the charge transporting layer coating liquid each used in Example 1 were applied in this order and dried to form a charge generating layer having a thickness of 0.3 μm and a charge transporting layer having a thickness of 20 μm, thereby producing an electrophotographic photoconductor formed of a support, a charge generating layer and a charge transporting layer.

Comparative Example 2

—Production of Electrophotographic Photoconductor—

Over a support (aluminum cylinder having a surface roughness (Rz) of 0.9 μm, a diameter of 30 mm and a length of 360 mm) used in Example 2, the charge generating layer coating liquid and the charge transporting layer coating liquid each used in Example 2 were applied in this order and dried to form a charge generating layer having a thickness of 0.3 μm and a charge transporting layer having a thickness of 20 μm, thereby producing an electrophotographic photoconductor formed of a support, a charge generating layer and a charge transporting layer.

Comparative Example 3

—Production of Electrophotographic Photoconductor—

Over a support (aluminum cylinder having a surface roughness (Rz) of 0.9 μm, a diameter of 30 mm and a length of 360 mm) used in Example 1, the charge generating layer coating liquid and the charge transporting layer coating liquid each used in Example 19 were applied in this order and dried to form a charge generating layer having a thickness of 0.3 μm and a charge transporting layer having a thickness of 20 μm, thereby producing an electrophotographic photoconductor formed of a support, a charge generating layer and a charge transporting layer.

Comparative Example 4

—Production of Electrophotographic Photoconductor—

Over a support (aluminum cylinder having a surface roughness (Rz) of 0.9 μm, a diameter of 30 mm and a length of 360 mm) used in Example 1, an intermediate layer coating liquid having the following composition, the charge generating layer coating liquid and the charge transporting layer coating liquid each used in Example 1 were applied in this order and dried to form an intermediate layer having a thickness of 3.5 μm, a charge generating layer having a thickness of 0.3 μm and a charge transporting layer having a thickness of 20 μm, thereby producing an electrophotographic photoconductor formed of a support, a charge generating layer and a charge transporting layer.

| [Intermediate layer coating liquid] | |
|---|---|
| alkyd resin (BECKOZOLE 1307-60-EL, produced by Dainippon Ink Chemical Industries Co., Ltd.) | 6 parts by mass |
| melamine resin (SUPER BECKAMINE G-821-60, produced by Dainippon Ink Chemical Industries Co., Ltd.) | 4 parts by mass |
| titanium oxide | 40 parts by mass |
| methylethylketone | 50 parts by mass |

Comparative Example 5

—Production of Electrophotographic Photoconductor—

Over a support (aluminum cylinder having a surface roughness (Rz) of 0.9 μm, a diameter of 30 mm and a length of 360 mm) used in Example 2, an intermediate layer coating liquid having the following composition, the charge generating layer coating liquid and the charge transporting layer coating liquid each used in Example 2 were applied in this order and dried to form an intermediate layer having a thickness of 3.5 μm, a charge generating layer having a thickness of 0.3 μm and a charge transporting layer having a thickness of 20 μm, thereby producing an electrophotographic photoconductor formed of a support, a charge generating layer and a charge transporting layer.

| [Intermediate layer coating liquid] | |
|---|---|
| alkyd resin (BECKOZOLE 1307-60-EL, produced by Dainippon Ink Chemical Industries Co., Ltd.) | 6 parts by mass |
| melamine resin (SUPER BECKAMINE G-821-60, produced by Dainippon Ink Chemical Industries Co., Ltd.) | 4 parts by mass |
| titanium oxide | 40 parts by mass |
| methylethylketone | 50 parts by mass |

Comparative Example 6

—Production of Electrophotographic Photoconductor—

Over a support (aluminum cylinder having a surface roughness (Rz) of 0.9 μm, a diameter of 30 mm and a length of 360 mm) used in Comparative Example 3, an intermediate layer coating liquid having the following composition, the charge generating layer coating liquid and the charge transporting layer coating liquid each used in Comparative Example 3 were applied in this order and dried to form an intermediate layer having a thickness of 3.5 μm, a charge generating layer having a thickness of 0.3 μm and a charge transporting layer having a thickness of 20 μm, thereby producing an electrophotographic photoconductor formed of a support, a charge generating layer and a charge transporting layer.

| [Intermediate layer coating liquid] | |
|---|---|
| alkyd resin (BECKOZOLE 1307-60-EL, produced by Dainippon Ink Chemical Industries Co., Ltd.) | 6 parts by mass |
| melamine resin (SUPER BECKAMINE G-821-60, produced by Dainippon Ink Chemical Industries Co., Ltd.) | 4 parts by mass |
| titanium oxide | 40 parts by mass |
| methylethylketone | 50 parts by mass |

Comparative Example 7

—Production of Electrophotographic Photoconductor—

An electrophotographic photoconductor was produced in a similar manner to that used in Comparative Example 4 except that the intermediate layer coating liquid of Comparative Example 4 was changed so as to have the following composition, and the thickness of the intermediate layer was changed to 2.0 μm.

| [Intermediate layer coating liquid] | |
|---|---|
| alkyd resin (BECKOZOLE 1307-60-EL, produced by Dainippon Ink Chemical Industries Co., Ltd.) | 6 parts by mass |
| melamine resin (SUPER BECKAMINE G-821-60, produced by Dainippon Ink Chemical Industries Co., Ltd.) | 4 parts by mass |
| methylethylketone | 50 parts by mass |

Comparative Example 8

—Production of Electrophotographic Photoconductor—

An electrophotographic photoconductor was produced in a similar manner to that used in Comparative Example 5 except that the intermediate layer coating liquid of Comparative Example 5 was changed so as to have the following composition, and the thickness of the intermediate layer was changed to 2.0 μm.

| [Intermediate layer coating liquid] | |
|---|---|
| alkyd resin (BECKOZOLE 1307-60-EL, produced by Dainippon Ink Chemical Industries Co., Ltd.) | 6 parts by mass |
| melamine resin (SUPER BECKAMINE G-821-60, produced by Dainippon Ink Chemical Industries Co., Ltd.) | 4 parts by mass |
| methylethylketone | 50 parts by mass |

Comparative Example 9

—Production of Electrophotographic Photoconductor—

An electrophotographic photoconductor was produced in a similar manner to that used in Comparative Example 6 except that the intermediate layer coating liquid of Comparative Example 6 was changed so as to have the following composition, and the thickness of the intermediate layer was changed to 2.0 μm.

| [Intermediate layer coating liquid] | |
|---|---|
| alkyd resin (BECKOZOLE 1307-60-EL, produced by Dainippon Ink Chemical Industries Co., Ltd.) | 6 parts by mass |
| melamine resin (SUPER BECKAMINE G-821-60, produced by Dainippon Ink Chemical Industries Co., Ltd.) | 4 parts by mass |
| methylethylketone | 50 parts by mass |

Comparative Example 10

—Production of Electrophotographic Photoconductor—

An electrophotographic photoconductor was produced in a similar manner to that used in Example 1 except that the sintered polycrystal constituting the intermediate layer of Example 1 was changed to a crystalline oxide composed of tin oxide, which was produced under the following conditions, using the remodeled RF sputtering apparatus described in Example 1.

[Forming Method of Intermediate Layer]

target: sintered polycrystal composed of tin oxide
cooling temperature of support: 30° C.
sputtering output power: 11.2 W/cm$^2$
distance between target and support surface: 50 mm
back pressure: $5.0\times10^{-6}$ torr or lower
film formation pressure: $3.0\times10^{-3}$ torr
inert gas: argon
oxygen partial pressure: 5% by volume relative to the total amount of inert gas and oxygen gas Comparative Example 11

—Production of Electrophotographic Photoconductor—

An electrophotographic photoconductor was produced in a similar manner to that used in Example 2 except that the sintered polycrystal constituting the intermediate layer of Example 2 was changed to a crystalline oxide composed of tin oxide, which was produced under the following conditions, using the remodeled RF sputtering apparatus described in Example 1.

[Forming Method of Intermediate Layer]

target: sintered polycrystal composed of tin oxide
cooling temperature of support: 30° C.
sputtering output power: 11.2 W/cm$^2$
distance between target and support surface: 50 mm
back pressure: $5.0\times10^{-6}$ torr or lower
film formation pressure: $3.0\times10^{-3}$ torr
inert gas: argon
oxygen partial pressure: 5% by volume relative to the total amount of inert gas and oxygen gas Comparative Example 12

—Production of Electrophotographic Photoconductor—

An electrophotographic photoconductor was produced in a similar manner to that used in Comparative Example 6 except that the sintered polycrystal constituting the intermediate layer of Comparative Example 6 was changed to a crystalline oxide composed of tin oxide, which was produced under the following conditions, using the remodeled RF sputtering apparatus described in Example 1.

[Forming Method of Intermediate Layer]

target: sintered polycrystal composed of tin oxide
cooling temperature of support: 30° C.
sputtering output power: 11.2 W/cm$^2$
distance between target and support surface: 50 mm
back pressure: $5.0\times10^{-6}$ torr or lower
film formation pressure: $3.0\times10^{-3}$ torr
inert gas: argon
oxygen partial pressure: 5% by volume relative to the total amount of inert gas and oxygen gas Comparative Example 13

—Production of Electrophotographic Photoconductor—

Over an electrophotographic photoconductor formed of a support, an intermediate layer, a charge generating layer and a charge transporting layer, which had been produced in the method described in Comparative Example 6, a surface layer coating liquid described in Example 19 was applied so as to form a surface layer in the same manner as in Example 19, thereby producing an electrophotographic photoconductor formed of a support, an intermediate layer, a charge generating layer, a charge transporting layer and a surface layer.

Comparative Example 14

—Production of Electrophotographic Photoconductor—

Over an electrophotographic photoconductor formed of a support, an intermediate layer, a charge generating layer and a charge transporting layer, which had been produced in the method described in Comparative Example 6, a surface layer coating liquid described in Example 20 was applied so as to have a surface layer in the same manner as in Example 20, thereby producing an electrophotographic photoconductor formed of a support, an intermediate layer, a charge generating layer, a charge transporting layer and a surface layer.

Comparative Example 15

—Production of Electrophotographic Photoconductor—

Over an electrophotographic photoconductor formed of a support, an intermediate layer, a charge generating layer and a charge transporting layer, which had been produced in the method described in Comparative Example 6, a surface layer coating liquid described in Example 21 was applied so as to form a surface layer in the same manner as in Example 20, thereby producing an electrophotographic photoconductor formed of a support, an intermediate layer, a charge generating layer, a charge transporting layer and a surface layer.

Comparative Example 16

—Production of Electrophotographic Photoconductor—

Over an electrophotographic photoconductor formed of a support, an intermediate layer, a charge generating layer and a charge transporting layer, which had been produced in the method described in Comparative Example 6, a surface layer coating liquid described in Example 22 was applied so as to form a surface layer in the same manner as in Example 22, thereby producing an electrophotographic photoconductor formed of a support, an intermediate layer, a charge generating layer, a charge transporting layer and a surface layer.

Comparative Example 17

—Production of Electrophotographic Photoconductor—

Over an electrophotographic photoconductor formed of a support, an intermediate layer, a charge generating layer and a charge transporting layer, which had been produced in the method described in Comparative Example 6, a surface layer coating liquid described in Example 23 was applied so as to form a surface layer in the same manner as in Example 23, thereby producing an electrophotographic photoconductor formed of a support, an intermediate layer, a charge generating layer, a charge transporting layer and a surface layer.

Comparative Example 18

—Production of Electrophotographic Photoconductor—

Over an electrophotographic photoconductor formed of a support, an intermediate layer, a charge generating layer and a charge transporting layer, which had been produced in the method described in Comparative Example 6, a surface layer coating liquid described in Example 24 was applied so as to form a surface layer in the same manner as in Example 24, thereby producing an electrophotographic photoconductor formed of a support, an intermediate layer, a charge generating layer, a charge transporting layer and a surface layer.

Comparative Example 19

—Production of Electrophotographic Photoconductor—

An electrophotographic photoconductor was produced in a similar manner to that used in Comparative Example 16 except that the intermediate layer coating liquid was changed so as to have the following composition, and the thickness of the intermediate layer was changed to 2.0 μm.

| [Intermediate layer coating liquid] | |
|---|---|
| alkyd resin (BECKOZOLE 1307-60-EL, produced by Dainippon Ink Chemical Industries Co., Ltd.) | 6 parts by mass |
| melamine resin (SUPER BECKAMINE G-821-60, produced by Dainippon Ink Chemical Industries Co., Ltd.) | 4 parts by mass |
| methylethylketone | 50 parts by mass |

Comparative Example 20

—Production of Electrophotographic Photoconductor—

An electrophotographic photoconductor was produced in a similar manner to that used in Comparative Example 17 except that the intermediate layer coating liquid was changed so as to have the following composition, and the thickness of the intermediate layer was changed to 2.0 μm.

| [Intermediate layer coating liquid] | |
|---|---|
| alkyd resin (BECKOZOLE 1307-60-EL, produced by Dainippon Ink Chemical Industries Co., Ltd.) | 6 parts by mass |
| melamine resin (SUPER BECKAMINE G-821-60, produced by Dainippon Ink Chemical Industries Co., Ltd.) | 4 parts by mass |
| methylethylketone | 50 parts by mass |

Comparative Example 21

—Production of Electrophotographic Photoconductor—

An electrophotographic photoconductor was produced in a similar manner to that used in Comparative Example 18 except that the intermediate layer coating liquid was changed so as to have the following composition, and the thickness of the intermediate layer was changed to 2.0 μm.

| [Intermediate layer coating liquid] | |
|---|---|
| alkyd resin (BECKOZOLE 1307-60-EL, produced by Dainippon Ink Chemical Industries Co., Ltd.) | 6 parts by mass |
| melamine resin (SUPER BECKAMINE G-821-60, produced by Dainippon Ink Chemical Industries Co., Ltd.) | 4 parts by mass |
| methylethylketone | 50 parts by mass |

Comparative Example 22

—Production of Electrophotographic Photoconductor—

An electrophotographic photoconductor formed of a support, a charge generating layer, a charge transporting layer and a surface layer was produced by using the charge generating layer forming method and charge transporting layer forming method described in Comparative Example 6 as well as the surface layer forming method described in Example 22.

Comparative Example 23

—Production of Electrophotographic Photoconductor—

An electrophotographic photoconductor formed of a support, a charge generating layer, a charge transporting layer and a surface layer was produced by using the charge generating layer forming method and charge transporting layer forming method described in Comparative Example 6 as well as the surface layer forming method described in Example 23.

Comparative Example 24

—Production of Electrophotographic Photoconductor—

An electrophotographic photoconductor formed of a support, a charge generating layer, a charge transporting layer and a surface layer was produced by using the charge generating layer forming method and charge transporting layer forming method described in Comparative Example 6 as well as the surface layer forming method described in Example 24.

Comparative Example 25

—Production of Electrophotographic Photoconductor—

An electrophotographic photoconductor was produced in a similar manner to that used in Example 22 except that the sintered polycrystal constituting the intermediate layer of Example 22 was changed to a crystalline oxide composed of tin oxide, which was produced under the following conditions, using the remodeled RF sputtering apparatus described in Example 1.

[Forming Method of Intermediate Layer]

target: sintered polycrystal composed of tin oxide cooling temperature of support: 30° C.

sputtering output power: 11.2 W/cm$^2$ distance between target and support surface: 50 mm
back pressure: $5.0\times10^{-6}$ torr or lower
film formation pressure: $3.0\times10^{-3}$ torr
inert gas: argon
oxygen partial pressure: 5% by volume relative to the total amount of inert gas and oxygen gas Comparative Example 26

—Production of Electrophotographic Photoconductor—

An electrophotographic photoconductor was produced in a similar manner to that used in Example 23 except that the sintered polycrystal constituting the intermediate layer of Example 23 was changed to a crystalline oxide composed of tin oxide, which was produced under the following conditions, using the remodeled RF sputtering apparatus described in Example 1.

[Forming Method of Intermediate Layer]
target: sintered polycrystal composed of tin oxide
cooling temperature of support: 30° C.
sputtering output power: 11.2 W/cm$^2$
distance between target and support surface: 50 mm
back pressure: $5.0\times10^{-6}$ torr or lower
film formation pressure: $3.0\times10^{-3}$ torr
inert gas: argon
oxygen partial pressure: 5% by volume relative to the total amount of inert gas and oxygen gas Comparative Example 27

—Production of Electrophotographic Photoconductor—

An electrophotographic photoconductor was produced in a similar manner to that used in Example 24 except that the sintered polycrystal constituting the intermediate layer of Example 24 was changed to a crystalline oxide composed of tin oxide, which was produced under the following conditions, using the remodeled RF sputtering apparatus described in Example 1.

[Forming Method of Intermediate Layer]
target: sintered polycrystal composed of tin oxide
cooling temperature of support: 30° C.
sputtering output power: 11.2 W/cm$^2$
distance between target and support surface: 50 mm
back pressure: $5.0\times10^{-6}$ torr or lower
film formation pressure: $3.0\times10^{-3}$ torr
inert gas: argon
oxygen partial pressure: 5% by volume relative to the total amount of inert gas and oxygen gas Thereafter, the electrophotographic photoconductors produced in Examples 1 to 18 and Comparative Examples 1 to 12 were subjected to the following test. Table 1 shows the test results.

<Evaluation of Electrostatic Properties and Image Quality after Electrostatic Fatigue Loading>

Electrostatic fatigue was loaded to each of the obtained electrophotographic photoconductors using the following method to thereby evaluate the resultant electrostatic properties and image quality after electrostatic fatigue loading.

Image forming members except for a charging unit, i.e., cleaning blade and the like were removed from a photoconductor unit in an image forming apparatus, IMAGIO NEO 271 manufactured by Ricoh Company Ltd., and a running test was carried out using the photoconductor unit. Then, each of the photoconductor units into which each of the photoconductors produced in Examples and Comparative Examples had been mounted was set to the remodeled image formation machine IMAGIO NEO 271 so as to carry out only charging and image developing process without passing paper therethrough.

As charging conditions, a charging roller was used, an alternating current voltage superimposed with a direct-current voltage was applied to the charging roller. The peak-to-peak voltage (Vpp) of the alternating-current voltage was set to about 1.9 kV, the frequency (f) was set to about 900 Hz, the direct-current voltage was set to −800V, and the rotational speed of the electrophotographic photoconductor was set to 125 mm/sec. As developing conditions, as to the electrophotographic photoconductors of Examples 1 to 18 and Comparative Examples 1, 2, 4, 5, 7, 8, 10 and 11 which had been produced using a phthalocyanine pigment as a charge generating material, a laser diode (LD) having a wavelength of 780 nm was used, as to the electrophotographic photoconductors of Comparative Examples of 3, 6, 9 and 12 which had been produced using a bisazo pigment as a charge generating material, a laser diode (LD) having a wavelength of 655 nm was used, and a 100% pattern (100% solid pattern) was used as a write pattern. In order to give electrostatic fatigue corresponding to running of 100,000 sheets under the above-mentioned conditions (5% test pattern/charging-exposing electric potential difference: 750V/electrostatic capacity of electrophotographic photoconductor: 110 pF/cm$^2$) to the electrophotographic photoconductor, it is necessary to perform running for approximately 2 hours. This is determined from a calculation of passing charge amount. In this evaluation, an electrostatic fatigue test corresponding to running for approximately 2 hours was carried out using the above-mentioned remodeled image formation machine, and the resultant image quality was evaluated using the following evaluation machine.

In the evaluation of image quality, similarly to the electrostatic fatigue test, as to the electrophotographic photoconductors of Examples 1 to 18 and Comparative Examples 1, 2, 4, 5, 7, 8, 10 and 11 which had been produced using a phthalocyanine pigment as a charge generating material, a machine IPSIO COLOR CX9000 in which a laser diode (LD) having a wavelength of 780 nm had been incorporated was used, and as to the electrophotographic photoconductors of Comparative Examples of 3, 6, 9 and 12 which had been produced using a bisazo pigment as a charge generating material, a machine IPSIO COLOR CX9000 in which a laser diode (LD) having a wavelength of 655 nm had been incorporated was used. Both of the machines were remodeled so as to avoid initial idle running during image output operation. As a toner, IMAGIO Toner type 27 (produced by Ricoh Company Ltd.) was used, and as paper, MY PAPER (A4 size) produced by NBS Ricoh Co., Ltd. Was used. A photoconductor surface potential at the start time of printing was set to −800V, and inner potentials of the machine before and after electrostatic fatigue loading (potential after charging (potential of dark space) and potential of exposed region) were evaluated. As an output image, full-surface white output or half-tone output processing was performed on 5 paper sheets in succession. Occurrence of background smear and nonuniformity of image density were visually observed to thereby evaluate the quality of the output image. Tables 1-A and 1-B show the evaluation results.

TABLE 1-A

| | Surface potential of electrophotographic photoconductor (−V) | | | | |
|---|---|---|---|---|---|
| | Potential at initial stage of running | | potential after electrostatic fatigue being loaded | | |
| | Potential at dark space | Potential at exposed region | Potential at dark space | Potential at exposed region | Evaluation of image quality |
| Ex. 1 | 805 | 70 | 790 | 85 | background smear slightly observed |
| Ex. 2 | 795 | 50 | 780 | 60 | Superior |
| Ex. 3 | 800 | 110 | 785 | 135 | Extremely superior |
| Ex. 4 | 790 | 80 | 780 | 95 | Extremely superior |
| Ex. 5 | 800 | 70 | 780 | 80 | background smear and moire slightly observed |
| Ex. 6 | 805 | 45 | 790 | 60 | Superior in background smear evaluation but moire slightly observed |
| Ex. 7 | 790 | 35 | 775 | 45 | Superior |
| Ex. 8 | 800 | 45 | 780 | 55 | Superior |
| Ex. 9 | 800 | 60 | 785 | 75 | Superior |
| Ex. 10 | 810 | 65 | 895 | 85 | Superior |
| Ex. 11 | 785 | 65 | 770 | 80 | Extremely superior |
| Ex. 12 | 795 | 70 | 780 | 90 | Extremely superior |
| Ex. 13 | 800 | 85 | 785 | 100 | Extremely superior |
| Ex. 14 | 810 | 90 | 790 | 110 | Extremely superior |
| Ex. 15 | 790 | 60 | 775 | 75 | Superior |
| Ex. 16 | 815 | 40 | 795 | 50 | Superior |
| Ex. 17 | 805 | 55 | 790 | 70 | Superior |
| Ex. 18 | 800 | 50 | 780 | 70 | Superior |

TABLE 1-B

| | Surface potential of electrophotographic photoconductor (−V) | | | | |
|---|---|---|---|---|---|
| | Potential at initial stage of running | | potential after electrostatic fatigue being loaded | | |
| | Potential at dark space | Potential at exposed region | Potential at dark space | Potential at exposed region | Evaluation of image quality |
| Compara. Ex. 1 | 785 | 60 | 720 | 75 | Background smear observed from initial stage |
| Compara. Ex. 2 | 790 | 45 | 715 | 55 | Background smear observed from initial stage |
| Compara. Ex. 3 | 790 | 30 | 715 | 45 | Background smear observed from initial stage |
| Compara. Ex. 4 | 805 | 105 | 765 | 140 | Background smear observed on $1^{st}$ to $5^{th}$ sheets after electrostatic fatigue loading |
| Compara. Ex. 5 | 800 | 90 | 770 | 125 | Background smear observed on $1^{st}$ to $5^{th}$ sheets after electrostatic fatigue loading |
| Compara. Ex. 6 | 810 | 55 | 765 | 95 | Background smear observed on $1^{st}$ to $5^{th}$ sheets after electrostatic fatigue loading |
| Compara. Ex. 7 | 810 | 150 | 780 | 215 | Image density became higher than the initial value |

TABLE 1-B-continued

| | Surface potential of electrophotographic photoconductor (−V) | | | | |
|---|---|---|---|---|---|
| | Potential at initial stage of running | | potential after electrostatic fatigue being loaded | | |
| | Potential at dark space | Potential at exposed region | Potential at dark space | Potential at exposed region | Evaluation of image quality |
| Compara. Ex. 8 | 815 | 130 | 775 | 200 | Image density became higher than in the initial stage |
| Compara. Ex. 9 | 810 | 100 | 780 | 175 | Image density became higher than in the initial stage |
| Compara. Ex. 10 | 800 | 65 | —(*1) | —(*1) | —(*1) |
| Compara. Ex. 11 | 795 | 45 | —(*1) | —(*1) | —(*1) |
| Compara. Ex. 12 | 795 | 40 | —(*1) | —(*1) | —(*1) |

(*1)It was found that the charge stability was inferior in the evaluation of image quality at initial stage, and thus running test was not carried out.

The evaluation results shown in Tables 1-A and 1-B demonstrated that all the electrophotographic photoconductors obtained in Examples had high-electrostatic charge stability as compared to the electrophotographic photoconductors obtained in Comparative Examples. Note that since the electrophotographic photoconductors obtained in Comparative Examples 10 to 12 were inferior in charge stability from the initial stage of the running test and a charge defect immediately occurred during the evaluation of image, an electrostatic fatigue test was not performed therefor.

The electrophotographic photoconductors of Examples 1 and 2, which had been produced by using a low-molecular weight charge transporting material as a charge transporting material, had a low-potential at exposed regions from the initial stage of the running test and also had superior electrostatic charge stability, but the electrophotographic photoconductor of Example 1 using a metal-free phthalocyanine as a charge generating material slightly caused background smear in the evaluation of image after the electrostatic fatigue test. In contrast, the electrophotographic photoconductors of Examples 3 and 4 using a polymeric charge transporting material as a charge transporting material did not cause image defects. The same holds true for the electrophotographic photoconductors of Examples 11 to 14 using a polymeric charge transporting material as a charge transporting material relative to a low-molecular weight charge transporting material as a charge transporting material in Examples 7 to 10, i.e., no image defects were caused by the electrophotographic photoconductors of Examples 11 to 14. However, as is clear from the results of electrostatic properties, the electrophotographic photoconductors obtained in Examples 3 and 4 carried a slightly higher potential at exposed regions than those of the electrophotographic photoconductors obtained in Examples 1 and 2. Similarly, the electrophotographic photoconductors obtained in Examples 11 to 14 carried a slightly higher potential at exposed regions than those of the electrophotographic photoconductors obtained in Examples 7 to 10. In particular, the electrophotographic photoconductor of Example 6 using a bisazo pigment as a charge generating material had a high residual potential (potential at exposed region) from the initial stage of the running test. This is considered to be a phenomenon caused by low-efficiency of charge generation and charge injection between the polymeric charge transporting material and the charge generating material used in Example 6 because of a small contact area therebetween. Thus, it is considered that a bisazo pigment as a charge generating material as well as a charge transporting material relate to the charge generation-injection mechanism, and therefore the potential particularly at exposed region was found to be high. Among them, the electrophotographic photoconductors of Examples 4 and 11 to 14 using a titanyl phthalocyanine pigment as a charge generating material had relatively low potential at exposed regions from the initial stage of the running test, caused less substantial increase in potential even after electrostatic fatigue being loaded, caused no image defects before and after electrostatic fatigue loading, and it was demonstrated that they make it possible to maintain their superior electrophotographic properties over a long period of time.

The electrophotographic photoconductor obtained in Example 5 compared favorably in test results with the electrophotographic photoconductors obtained in Examples 1 to 3, however, occurrence of moiré was confirmed to appear in output images.

In Examples 15 to 18, there are shown results of using an intermediate layer in which constituent elements of an amorphous oxide were changed and the composition ratio was changed. It is demonstrated that these electrophotographic photoconductors had a sufficiently low potential at exposed regions and had less variation in electric potential even after electrostatic fatigue being loaded, caused less image defects, and are excellent in electrostatic charge stability.

The electrophotographic photoconductors obtained in Comparative Examples 1 to 3 had a low electric potential from the initial stage of the running test, similarly to those of Examples 1 to 3 and exhibited superior properties in the initial stage, however, variation in potential at dark space and variation in potential at exposed region became substantially greater, causing degradation in electrostatic charge stability and frequent occurrence of background smear from the initial stage of the running test. It was demonstrated that these photoconductors frequently caused image defects and were poor in electrostatic charge stability, as compared to the electrophotographic photoconductors of Examples 1 to 3.

The electrophotographic photoconductors obtained in Comparative Examples 4 to 6 carried high electric potential at exposed regions in the initial stage of the running test and had great variations in potential at dark space and potential at exposed region before and after the electrostatic fatigue test. Also, the evaluation results of image quality before and after electrostatic fatigue test showed that these electrophotographic photoconductors caused background smear and were poor in electrostatic charge stability as compared to those obtained in Examples 1 to 3.

It was demonstrated that the electrophotographic photoconductors obtained in Comparative Examples 7 to 9 carried a high electric potential at exposed regions from the initial stage of the running test, had an extremely great value of potential after the electrostatic fatigue test and were inferior in light attenuation function and electrostatic charge stability.

<Evaluation of Abrasion Resistance>

The electrophotographic photoconductors produced in Examples 19 to 43 and Comparative Examples 13 to 27 were evaluated as to their abrasion resistance according to the following method.

In a remodeled image formation machine, IMAGIO NEO 271 manufactured by Ricoh Company Ltd., in which each of the produced photoconductors was mounted to a process cartridge for electrophotographic apparatus, and a semiconductor laser having a wavelength of 655 nm was used as a light source for exposure of image, the initial electric potential for dark space was set to −800V. Then, a running test of passing 50,000 sheets of paper in A4 size was carried out. Film thicknesses of each of the electrophotographic conductors at initial stage of paper passing test and after outputting 50,000 sheets were measured, and a reduced amount of film thickness was determined. Also, as electric properties, electric potential at dark space and electric potential at an exposed region were measured at the initial stage of paper passing test and after outputting 50,000 sheets. Tables 2-A and 2-B show the test results.

—Measurement of Film Thickness of Electrophotographic Photoconductor—

The film thickness of each of the electrophotographic photoconductors was measured using an eddy-current thickness meter (manufactured by Fischer Instrument).

Hardness degrees of surface layers formed in Examples 19 to 43 and Comparative Examples 13 to 27 were determined by the following method.

<Hardness Degree of Surface Layer>

A surface of each of the produced electrophotographic photoconductors was rubbed with a swab containing tetrahydrofuran 10 times, and a change in coated film surface was observed to thereby evaluate the hardness degree. As a result, no change was found in all the electrophotographic photoconductors, and the electrophotographic photoconductor surfaces were found to be excellently hardened. Each of the electrophotographic photoconductors of Examples 25 to 38 and Comparative Examples 13 to 27 had a similar surface layer to those formed in Examples 19 to 24, and thus it was confirmed that all the electrophotographic photoconductors produced in Examples and Comparative Examples had an excellently hardened surface layer. Note that only in the electrophotographic photoconductor of Example 24, a swab was slightly changed in color. This is considered attributable to the fact that the electrophotographic photoconductor of Example 24 had a surface layer in which a charge transporting material having no radical polymerizable functional group had been included, unlike electrophotographic photoconductors of Examples 19 to 23.

TABLE 2-A

| | Reduction | Surface potential of electrophotographic photoconductor (−V) | | | |
|---|---|---|---|---|---|
| | | At initial stage of running | | after outputting 50,000 sheets | |
| | in film thickness (μm) | Potential at dark space | Potential at exposed region | Potential at dark space | Potential at exposed region |
| Ex. 19 | 0.5 | 805 | 75 | 785 | 85 |
| Ex. 20 | 0.85 | 805 | 65 | 790 | 80 |
| Ex. 21 | 0.7 | 810 | 80 | 795 | 90 |
| Ex. 22 | 0.41 | 800 | 70 | 790 | 85 |
| Ex. 23 | 0.42 | 795 | 65 | 770 | 75 |
| Ex. 24 | 1.39 | 800 | 85 | 790 | 95 |
| Ex. 25 | 0.39 | 790 | 65 | 785 | 75 |
| Ex. 26 | 0.39 | 800 | 65 | 790 | 80 |
| Ex. 27 | 0.41 | 810 | 75 | 805 | 80 |
| Ex. 28 | 0.4 | 815 | 85 | 805 | 90 |
| Ex. 29 | 0.4 | 785 | 55 | 780 | 65 |
| Ex. 30 | 0.42 | 795 | 60 | 790 | 70 |
| Ex. 31 | 0.41 | 810 | 70 | 805 | 75 |
| Ex. 32 | 0.41 | 820 | 75 | 810 | 80 |
| Ex. 33 | 1.42 | 790 | 80 | 785 | 85 |
| Ex. 34 | 1.38 | 805 | 80 | 795 | 85 |
| Ex. 35 | 1.39 | 810 | 95 | 805 | 100 |
| Ex. 36 | 1.39 | 810 | 100 | 805 | 105 |
| Ex. 37 | 0.42 | 795 | 70 | 790 | 75 |
| Ex. 38 | 1.42 | 800 | 90 | 790 | 95 |
| Ex. 39 | 0.37 | 795 | 95 | 790 | 110 |
| Ex. 40 | 0.38 | 795 | 95 | 790 | 110 |
| Ex. 41 | 0.42 | 800 | 70 | 790 | 80 |
| Ex. 42 | 0.41 | 810 | 75 | 800 | 95 |
| Ex. 43 | 0.4 | 790 | 55 | 785 | 55 |

TABLE 2-B

| | Reduction | Surface potential of electrophotographic photoconductor (−V) | | | |
|---|---|---|---|---|---|
| | | At initial stage of running | | after outputting 50,000 sheets | |
| | in film thickness (μm) | Potential at dark space | Potential at exposed region | Potential at dark space | Potential at exposed region |
| Compara. Ex. 13 | 0.53 | 790 | 110 | 765 | 140 |
| Compara. Ex. 14 | 0.84 | 805 | 100 | 770 | 135 |
| Compara. Ex. 15 | 0.73 | 800 | 105 | 765 | 130 |
| Compara. Ex. 16 | 0.4 | 810 | 110 | 775 | 140 |
| Compara. Ex. 17 | 0.4 | 795 | 110 | 755 | 135 |
| Compara. Ex. 18 | 1.35 | 800 | 105 | 770 | 140 |
| Compara. Ex. 19 | 0.41 | 820 | 135 | 810 | 175 |
| Compara. Ex. 20 | 0.38 | 810 | 130 | 795 | 160 |
| Compara. Ex. 21 | 1.36 | 815 | 155 | 805 | 220 |
| Compara. Ex. 22 | 0.39 | 795 | 75 | 740 | 80 |
| Compara. Ex. 23 | 0.41 | 790 | 65 | 755 | 75 |
| Compara. Ex. 24 | 1.43 | 795 | 80 | 730 | 90 |
| Compara. Ex. 25 | *Impossible to evaluate | 800 | — | 70 | — |
| Compara. Ex. 26 | *Impossible to evaluate | 805 | — | 60 | — |

TABLE 2-B-continued

| | Reduction in film thickness (μm) | Surface potential of electrophotographic photoconductor (−V) At initial stage of running: Potential at dark space | At initial stage of running: Potential at exposed region | after outputting 50,000 sheets: Potential at dark space | after outputting 50,000 sheets: Potential at exposed region |
|---|---|---|---|---|---|
| Compara. Ex. 27 | *Impossible to evaluate | 790 | — | 85 | — |

*A conspicuous reduction in charge potential was confirmed from the initial stage of electrostatic fatigue test, and thus the evaluation was stopped.

The results shown in Tables 2-A and 2-B demonstrated that the electrophotographic photoconductors of Examples 19 to 23, 39 and Comparative Examples 13 to 17 had a surface layer which had a smaller abrasion loss and extremely superior abrasion resistance than those of the electrophotographic photoconductors of Example 24 and Comparative Example 18. The electrophotographic photoconductors of Example 24 and Comparative Example 18 made it possible to perform the running of 50,000 sheets without no problem without no problem, although they caused a slight increase in abrasion loss. The results of surface potential of the electrophotographic photoconductors demonstrated that all the electrophotographic photoconductors obtained in Examples had a low electric potential at exposed regions in the initial stage of the running test and after the running of 50,000 sheets and exhibited their electric potential stability. Meanwhile, the electrophotographic photoconductors of Comparative Examples 13 to 18 had a tendency to have a slightly high electric potential at exposed regions and exhibited an electric potential 1.5 times or higher than the electrophotographic photoconductors obtained in Examples 19 to 24 after the running of 50,000 sheets. This demonstrated that the electrophotographic photoconductors obtained in Examples had less abrasion on their surfaces in a short period of output running time and had small variation in photoconductor properties.

Next, based on the results shown in Tables 2-A and 2-B, the number of running paper sheets required until each surface layer (with a thickness of 5.0 μm) of the electrophotographic photoconductors of Examples 19 to 24 and 39 had disappeared was counted. Table 3 shows the results.

TABLE 3

| | Lifetime of surface layer (corresponding value) |
|---|---|
| Ex. 19 | 500,000 sheets |
| Ex. 20 | 294,000 sheets |
| Ex. 21 | 357,000 sheets |
| Ex. 22 | 625,000 sheets |
| Ex. 23 | 595,000 sheets |
| Ex. 24 | 180,000 sheets |
| Ex. 39 | 675,000 sheets |

When the lifetime of the electrophotographic photoconductors of Examples 19 to 24 in relation to the abrasion resistance corresponds to the number of running sheets required until each surface layer of the electrophotographic photoconductors had disappeared, it can be said in other words that, these electrophotographic photoconductor had a lifetime for abrasion resistance of from about 180,000 sheets to 670,000 sheets. Therefore, as to the electrostatic resistance focused in the present invention, there is a need for an electrophotographic photoconductor to have durability higher than the resistance corresponding to the lifetime for abrasion resistance described above.

<Evaluation of Electrostatic Resistance>

It can be said from the lifetime for abrasion resistance results shown in Table 3 that they are electrophotographic photographic photoconductors having extremely high resistance in which the abrasion resistance is in proportion to the electrostatic resistance, if it is verified that these electrophotographic photoconductors have less reduction in various photoconductor properties after output running of at least 700,000 sheets. However, it is not realistic to evaluate the electrostatic resistance by passing the corresponding number of sheets through all the electrophotographic photoconductors produced in Examples and Comparative Examples. Therefore, in the present invention, electrostatic fatigue was loaded to each of these electrophotographic photoconductors by the following method to thereby evaluate the electrostatic resistance thereof.

Image forming members except for a charging unit, i.e., cleaning blade and the like were removed from a photoconductor unit in an image forming apparatus, IMAGIO NEO 271 manufactured by Ricoh Company Ltd., and a running test was carried out using the photoconductor unit.

Then, each of the photoconductor units into which each of the photoconductors produced in Examples and Comparative Examples had been mounted was set to the remodeled image formation machine IMAGIO NEO 271 so as to carry out only charging and image developing process without passing paper therethrough.

As charging conditions, a charging roller was used, an alternating current voltage superimposed with a direct-current voltage was applied to the charging roller. The peak-to-peak voltage (Vpp) of the alternating-current voltage was set to about 1.9 kV; the frequency (f) was set to about 900 Hz, the direct-current voltage was set to −800V, and the rotational speed of the electrophotographic photoconductor was set to 125 mm/sec. As developing conditions, a laser diode (LD) having a wavelength of 650 nm was used, and a 100% pattern (100% solid pattern) was used as a write pattern. In order to give electrostatic fatigue corresponding to running of 700,000 sheets under the above-mentioned conditions (5% test pattern/charging-exposing electric potential difference: 750V/electrostatic capacity of electrophotographic photoconductor: 110 pF/cm$^2$) to the electrophotographic photoconductor, it is necessary to perform running for approximately 15.5 hours. This is determined from a calculation of passing charge amount.

The individual electrophotographic photoconductors of Examples and Comparative Examples were subjected to measurement of charge potential and electric potential at exposed regions before and after the running test and an output running test (5 sheets in succession) of a 0% test pattern (white image) image and a halftone image. Thereby, whether background smear and moiré had occurred or not was confirmed. Tables 4-A, 4B and 4-C show the evaluation results.

TABLE 4-A

| | Surface potential of electrophotographic photoconductor | | | | After running | |
|---|---|---|---|---|---|---|
| | At initial stage of running | | After electrostatic fatigue being loaded | | Background | |
| | Charge potential | Potential at exposed region | Charge potential | Potential at exposed region | smear | Image defect |
| Ex. 19 | 805 | 75 | 780 | 100 | Not occurred | Not occurred |
| Ex. 20 | 805 | 65 | 770 | 95 | Not occurred | Not occurred |
| Ex. 21 | 810 | 80 | 775 | 100 | Not occurred | Not occurred |
| Ex. 22 | 800 | 70 | 770 | 105 | Not occurred | Not occurred |
| Ex. 23 | 795 | 65 | 775 | 90 | Not occurred | Not occurred |
| Ex. 24 | 800 | 85 | 760 | 110 | Not occurred | Not occurred |
| Ex. 25 | 790 | 65 | 770 | 85 | Partly occurred | Not occurred |
| Ex. 26 | 800 | 65 | 775 | 90 | Not occurred | Not occurred |
| Ex. 27 | 810 | 75 | 795 | 105 | Not occurred | Not occurred |
| Ex. 28 | 815 | 85 | 795 | 110 | Not occurred | Not occurred |
| Ex. 29 | 785 | 55 | 770 | 75 | Partly occurred | Not occurred |
| Ex. 30 | 795 | 60 | 775 | 85 | Not occurred | Not occurred |

TABLE 4-B

| | Surface potential of electrophotographic photoconductor | | | | After running | |
|---|---|---|---|---|---|---|
| | At initial stage of running | | After electrostatic fatigue being loaded | | Background | |
| | Charge potential | Potential at exposed region | Charge potential | Potential at exposed region | smear | Image defect |
| Ex. 31 | 810 | 70 | 800 | 95 | Not occurred | Not occurred |
| Ex. 32 | 820 | 75 | 795 | 110 | Not occurred | Not occurred |
| Ex. 33 | 790 | 80 | 775 | 105 | Partly occurred | Not occurred |
| Ex. 34 | 805 | 80 | 775 | 110 | Not occurred | Not occurred |
| Ex. 35 | 810 | 95 | 790 | 120 | Not occurred | Not occurred |
| Ex. 36 | 810 | 100 | 795 | 125 | Not occurred | Not occurred |
| Ex. 37 | 795 | 70 | 775 | 95 | Not occurred | Moire slightly occurred |
| Ex. 38 | 800 | 90 | 760 | 110 | Not occurred | Moire slightly occurred |
| Ex. 39 | 810 | 95 | 760 | 135 | Not occurred | Not occurred |
| Ex. 40 | 795 | 775 | 65 | 110 | Not occurred | Not occurred |
| Ex. 41 | 800 | 760 | 70 | 130 | Not occurred | Not occurred |
| Ex. 42 | 710 | 760 | 75 | 125 | Not occurred | Not occurred |
| Ex. 43 | 790 | 780 | 55 | 80 | Not occurred | Not occurred |

TABLE 4-C

| | Surface potential of electrophotographic photoconductor | | | | | |
|---|---|---|---|---|---|---|
| | At initial stage of running | | After electrostatic fatigue being loaded | | | |
| | Charge potential | Potential at exposed region | Charge potential | Potential at exposed region | Image quality obtained after running | |
| | | | | | Background smear | Image defect |
| Compara. Ex. 13 | 790 | 110 | 740 | 155 | Occurred on entire surface | Non-uniformity of image density occurred |
| Compara. Ex. 14 | 805 | 100 | 750 | 150 | Occurred on entire surface | Non-uniformity of image density occurred |
| Compara. Ex. 15 | 800 | 105 | 745 | 155 | Occurred on entire surface | Non-uniformity of image density occurred |
| Compara. Ex. 16 | 810 | 110 | 755 | 160 | Occurred on entire surface | Non-uniformity of image density occurred |
| Compara. Ex. 17 | 795 | 110 | 745 | 150 | Occurred on entire surface | Non-uniformity of image density occurred |
| Compara. Ex. 18 | 800 | 105 | 755 | 165 | Occurred on entire surface | Non-uniformity of image density occurred |
| Compara. Ex. 19 | 820 | 135 | 775 | 255 | Impossible to evaluate | |
| Compara. Ex. 20 | 810 | 130 | 760 | 220 | Impossible to evaluate | |
| Compara. Ex. 21 | 815 | 155 | 770 | 315 | Impossible to evaluate | |
| Compara. Ex. 22 | 795 | 75 | 630 | 90 | Frequently occurred on entire surface | Non-uniformity of image density slightly occurred and its density increased |
| Compara. Ex. 23 | 790 | 65 | 655 | 90 | Frequently occurred on entire surface | Non-uniformity of image density slightly occurred and its density increased |
| Compara. Ex. 24 | 795 | 80 | 640 | 115 | Frequently occurred on entire surface | Non-uniformity of image density slightly occurred and its density increased |

TABLE 4-C-continued

| | Surface potential of electrophotographic photoconductor | | | | | |
|---|---|---|---|---|---|---|
| | At initial stage of running | | After electrostatic fatigue being loaded | | | |
| | Charge potential | Potential at exposed region | Charge potential | Potential at exposed region | Image quality obtained after running | |
| | | | | | Background smear | Image defect |
| Compara. Ex. 25 | 800 | 70 | — | — | | Impossible to evaluate |
| Compara. Ex. 26 | 805 | 60 | — | — | | Impossible to evaluate |
| Compara. Ex. 27 | 790 | 85 | — | — | | Impossible to evaluate |

As described above, since the charge potentials of the electrophotographic photoconductors of Comparative Examples 25 to 27 were confirmed to significantly decrease from the initial stage of the running for electrostatic fatigue, the evaluation of the electrostatic resistance was not performed.

As can be seen from the results shown in Tables 4-A, 4-B and 4-C, the electrophotographic photoconductors of Examples 19 to 43 had small variation in charge potential and electric potential at exposed region and did not nearly cause non-uniformity of image density. As to the electrophotographic photoconductors of Examples 37 and 38, moiré slightly occurred during output of the halftone image.

In contrast, the electrophotographic photoconductors of Comparative Examples 13 to 18 did not cause so great variations in charge potential and electric potential at exposed regions, but as compared to those of the electrophotographic photoconductors obtained in Examples, the variations were large, and occurrence of background smear was confirmed. Further, non-uniformity of image density occurred on the $2^{nd}$ and subsequent sheets of the halftone output image.

As to the electrophotographic photoconductors of Comparative Examples 19 to 21, it was impossible to evaluate the image quality due to a significant increase in electric potential after electrostatic fatigue being loaded.

The electrophotographic photoconductors of Comparative Examples 22 to 24 caused a large reduction in charge potential after electrostatic fatigue being loaded, and the occurrence of background smear was significantly higher than that of Examples and Comparative Examples 13 to 18.

For the reasons stated above, it was understood that the electrophotographic photoconductors of Examples 1 to 43 had small variation in barrier electrostatic properties and had less defects relating to image quality.

In an image forming apparatus, an image forming method and a process cartridge each according to the present invention, an electrophotographic photoconductor of the present invention is used which has substantially less reduction in properties such as abrasion resistance and electrostatic resistance, and thus the image forming apparatus, image forming method and process cartridge can be widely used in laser printers, direct digital plate makers, full-color copiers each using a direct or indirect electrophotographic multi-color image developing system, full-color laser printers, and full-color plain-paper facsimiles and the like.

What is claimed is:

1. An electrophotographic photoconductor comprising:

a support, at least an intermediate layer, and a photosensitive layer, the intermediate layer and photosensitive layer being laid in this order over the support, wherein the intermediate layer consists of an amorphous oxide semiconductor, and wherein the amorphous oxide semiconductor comprises at least indium, zinc, and gallium.

2. The electrophotographic photoconductor according to claim 1, wherein the photosensitive layer is a multilayered type which is formed of a charge generating layer and a charge transporting layer.

3. The electrophotographic photoconductor according to claim 1, wherein the photosensitive layer comprises phthalocyanine as a charge generating material.

4. The electrophotographic photoconductor according to claim 3, wherein the phthalocyanine has a maximum diffraction peak at a Bragg angle of ($2\theta \pm 0.2°$) 27.2° and a minimum diffraction peak at 7.3° in an X-ray diffraction spectrum with a CuK$\alpha$ radiation source.

5. The electrophotographic photoconductor according to claim 1, wherein the photosensitive layer comprises a binder resin, and the binder resin is a polymeric charge transporting material.

6. The electrophotographic photoconductor according to claim 5, wherein the polymeric charge transporting material is at least one polymer selected from polycarbonates, polyurethanes, polyesters, and polyethers.

7. The electrophotographic photoconductor according to claim 6, wherein the polymeric charge transporting material has a triarylamine structure.

8. The electrophotographic photoconductor according to claim 1, further comprising a surface layer on the photosensitive layer, wherein the surface layer comprises a hardened material composed of at least a radically polymerizable compound, and a photoradical polymerization initiator.

9. The electrophotographic photoconductor according to claim 8, wherein a functional group of the radically polymerizable compound is at least one selected from acryloyloxy groups, and methacryloyloxy groups.

10. The electrophotographic photoconductor according to claim 9, wherein the radically polymerizable compound is a radically polymerizable compound having no charge transporting structure.

11. The electrophotographic photoconductor according to claim 9, wherein the radically polymerizable compound is a mixture of a radically polymerizable compound having no charge transporting structure, and a radically polymerizable compound having a charge transporting structure.

12. The electrophotographic photoconductor according to claim 11, wherein a charge transporting portion of the radically polymerizable compound having a charge transporting structure has a triarylamine structure.

13. The electrophotographic photoconductor according to claim 1, wherein the support has a surface roughness (Rz) of 0.6 μm or more.

14. An image forming apparatus comprising:

an electrophotographic photoconductor, a charging unit configured to charge a surface of the electrophotographic photoconductor, an exposing unit configured to expose the surface of the electrophotographic photoconductor to form a latent electrostatic image, a developing unit configured to develop the latent electrostatic image using a toner to form a visible image, and a transfer unit configured to transfer the visible image onto a recording medium, wherein the electrophotographic photoconductor comprises a support, at least an intermediate layer, and a photosensitive layer, the intermediate layer and photosensitive layer being laid in this order over the support, wherein the intermediate layer consists of an amorphous oxide semiconductor, and wherein the amorphous oxide semiconductor comprises at least indium, zinc, and gallium.

15. A process cartridge detachably mounted on a main body of an image forming apparatus, the process cartridge comprising:

an electrophotographic photoconductor, and a developing unit configured to develop a latent electrostatic image formed on the electrophotographic photoconductor using a toner to form a visible image, wherein the electrophotographic photoconductor comprises a support, at least an intermediate layer, and a photosensitive layer, the intermediate layer and photosensitive layer being laid in this order over the support, wherein the intermediate layer consists of an amorphous oxide semiconductor, and wherein the amorphous oxide semiconductor comprises at least indium, zinc, and gallium.

16. The electrophotographic photoconductor according to claim 1, wherein the intermediate layer composed of the amorphous oxide semiconductor has a transportability property to transport electric charges, generated in the photosensitive layer and having same polarity as that of the photoconductor, from the photosensitive layer to the support, and has a blocking property to prevent electric charges having a polarity opposite to that of the photoconductor from being injected from the support into the photosensitive layer.

17. The electrophotographic photoconductor according to claim 1, wherein the intermediate layer composed of the amorphous oxide semiconductor is formed by sputtering a polycrystalline sintered body containing elements constituting the amorphous oxide semiconductor.

* * * * *